US009221602B2

(12) United States Patent
Goedken et al.

(10) Patent No.: US 9,221,602 B2
(45) Date of Patent: Dec. 29, 2015

(54) LINEARLY EXTENDABLE COLLECTION MECHANISM FOR REFUSE HAULING VEHICLES

(75) Inventors: Kenneth D. Goedken, Dubuque, IA (US); Jared L. Rowland, Dyersville, IA (US); Marlin L. Johnson, Guttenberg, IA (US); Roger Taake, Elkader, IA (US); Keith Drewelow, Luxemburg, IA (US)

(73) Assignee: Kann Manufacturing Corporation, Guttenberg, IA (US)

( * ) Notice: Subject to any disclaimer, the term of this patent is extended or adjusted under 35 U.S.C. 154(b) by 809 days.

(21) Appl. No.: 13/413,718

(22) Filed: Mar. 7, 2012

(65) Prior Publication Data

US 2012/0230803 A1 Sep. 13, 2012

Related U.S. Application Data

(60) Provisional application No. 61/451,777, filed on Mar. 11, 2011, provisional application No. 61/534,633, filed on Sep. 14, 2011.

(51) Int. Cl.

| | |
|---|---|
| ***B65F 3/04*** | (2006.01) |
| ***B65F 3/00*** | (2006.01) |
| *B65F 3/02* | (2006.01) |

(52) U.S. Cl.

CPC ..... *B65F 3/001* (2013.01); *B65F 3/043* (2013.01); *B65F 3/046* (2013.01); *B65F 2003/024* (2013.01); *B65F 2003/0246* (2013.01); *B65F 2003/0269* (2013.01)

(58) Field of Classification Search

CPC ..... B65F 3/001; B65F 3/02; B65F 3/041; B65F 3/048; B65F 2003/0269

See application file for complete search history.

(56) References Cited

U.S. PATENT DOCUMENTS

| | | | | | |
|---|---|---|---|---|---|
| 3,516,562 | A | * | 6/1970 | Knight | 414/408 |
| 3,844,434 | A | * | 10/1974 | Blakeley et al. | 414/409 |
| 4,714,140 | A | * | 12/1987 | Hatton et al. | 180/20 |

(Continued)

FOREIGN PATENT DOCUMENTS

| | | | | | |
|---|---|---|---|---|---|
| DE | 3917307 | C1 | * | 4/1990 | B65F 3/08 |
| DE | 29512883 | U1 | * | 9/1995 | B65F 3/02 |
| GB | 2418901 | A | * | 4/2006 | B65F 3/08 |
| JP | 7-56242 | | | 12/1995 | |
| JP | 9-58805 | | | 3/1997 | |

OTHER PUBLICATIONS

Side view photo of recycling body in use by Assignee prior to Mar. 1, 2010 (IDS2-NPL-Photo1.pdf).

(Continued)

*Primary Examiner* — James Keenan

(74) *Attorney, Agent, or Firm* — Brett D. Papendick; Shuttleworth & Ingersoll, PLC

(57) ABSTRACT

An improved recyclables collection vehicle includes a lift mechanism for selective loading into any one of multiple hoppers on the vehicle. The lift mechanism includes a track which extends past the rear of the vehicle such that a moveable carriage may move along the track to collect a refuse bin located to the rear of the vehicle or on an elevated dock behind or alongside the vehicle. The carriage can be aligned with any one of the hoppers such that the lift mechanism will elevate the refuse bin and invert it over the hopper container. The movement of the carriage along the track and the raising of the lift mechanism are operated with a wireless remote control.

13 Claims, 20 Drawing Sheets

(56) References Cited

U.S. PATENT DOCUMENTS

| | | | | |
|---|---|---|---|---|
| 5,007,786 | A * | 4/1991 | Bingman | 414/409 |
| 5,035,563 | A * | 7/1991 | Mezey | 414/409 |
| 5,071,307 | A | 12/1991 | Carson | |
| 5,222,853 | A * | 6/1993 | Carson | 414/408 |
| 5,525,022 | A * | 6/1996 | Huntoon | 414/409 |
| 6,474,928 | B1 | 11/2002 | Christenson | |

OTHER PUBLICATIONS

Rear view photo of recycling body in use by Assignee prior to Mar. 1, 2010 (IDS2-NPL-Photo2.pdf).

Written Opinion of the International Searching Authority dated Nov. 20, 2012 for co-pending PCT Application.

* cited by examiner

LINEARLY EXTENDABLE COLLECTION MECHANISM FOR REFUSE HAULING VEHICLES

CROSS REFERENCE TO RELATED APPLICATIONS

This application claims priority under 35 USC §119 from copending provisional patent application entitled LINEARLY EXTENDABLE COLLECTION MECHANISM FOR REFUSE HAULING VEHICLES, Ser. No. 61/451,777, filed Mar. 11, 2011 and provisional patent application entitled LOW PROFILE SIDE LOADING COMMODITY COLLECTION BODY, Ser. No. 61/534,633, filed Sep. 14, 2011. The disclosures of provisional patent application Ser. No. 61/451,777 and patent application Ser. No. 61/534,633 are hereby incorporated in their entireties.

BACKGROUND OF THE INVENTION

Commodity (refuse or recycling) collection trucks come in three main types: front end loading, rear end loading, and side loading. In the case of side loading commodity collection bodies, certain collection bodies are separated into multiple compartments or hoppers into which different kinds of commodity may be loaded.

Collection of refuse commodities including organic and recyclable wastes requires efficient collection from commercial, industrial and manufacturing locations. In these environments numerous bins and containers are often used to accommodate large amounts of waste and recyclable material, and difficulties arise in efficiently emptying all the individual bins and containers into the commodity collection truck. Difficulties also arise in maneuvering bins and containers from certain locations and from elevated docks to locations accessible by commodity collection trucks.

Economic and social changes have occurred in society's handling of waste commodities. The efforts by municipalities to lengthen the lifetime of landfills have led to increasing efforts to divert waste from the landfill. Attitudes have changed about waste commodities which have led to efforts to recycle and reuse various castoffs of industry and households alike. Yard wastes are being diverted to composting operations. Food scraps and other wastes from food preparation operations are being diverted to conversion to fuels such as diesel fuel. Aluminum and steel are recovered for conversion into new products. Paper products are diverted to reformulation as post-waste paper goods. Thermally formed plastics are ground and reused for products. Plus, the need for segregation of biologic hazards and medical waste has fueled the need for refuse collection bodies which can haul multiple types of waste commodities in segregated containers. In many hospital environments, biologic waste is collected from low height hospital loading docks frequently built for unloading of panel trucks and such loading docks are often covered. The increases in biologic and medical waste have made it impractical for such commodities to be efficiently removed by small general purpose utility vehicles.

The increased efforts to recycle and reuse components of the varied waste streams has created new challenges especially when dealing with dense urban environments, which include narrow streets and alleys, low overhanging utility lines, and tight access to loading docks. Obviously, society prefers that waste commodities exit a business at the rear, and rear exits are usually located along a narrow alleyway and frequently include a loading dock that was built long ago with no expectation that it might be used in the Twenty-first century. It is not uncommon for loading docks to include covers or awnings to shelter the dock structure. Overhead obstructions and narrow passageways make it impossible for a conventional refuse and recycling collection trucks to automatically load from the rear of an older building, from a covered loading dock or from an area where there are low hanging utility cables or other overhead obstructions.

Standard practice anticipates that refuse and recycling collection trucks are loaded without regard for overhead limitations, that is, with no obstruction overhead. Therefore the only height restriction applied to existing refuse collection trucks has been that imposed by highway usage, that is, overpass clearances and bridge superstructure heights.

Therefore, in urban environments, handling of waste and recycling collection necessitates the manual relocation of waste and recycling receptacles from a rear loading area to an open street where a full-size waste collection truck may pass without overhead obstacles such as low hanging utility lines and low dock overhangs. Automated collection of varied waste commodities is impossible due to the impossibility of maneuvering a conventional waste collection truck in such areas.

A mechanism that permits automated unloading of bins and containers into a refuse and recycling collection vehicle from a dock or other location above ground level is needed for refuse collection activities in commercial, industrial and manufacturing environments.

An apparatus which allows commodity containers to be retrieved from a location posterior to the collection vehicle, either from ground level or from a raised platform, would reduce the amount of labor needed and increase the safety in the collection of commodity from such containers.

SUMMARY OF THE INVENTION

The present invention discloses an improved commodity collection truck which can retrieve refuse bins from loading docks and from locations directly behind the collection truck and can empty the bins into selected separated storage compartments on the collection truck. The invention is particularly useful in alleyways and other locations with limited areas for repositioning of the commodity collection truck. It is particularly useful for locations where refuse bins are available under an overhang, or where the refuse bins are stored on a loading dock.

The commodity collection truck includes one or more storage compartments, typically more than one, such that differing types of commodity may be loaded into the storage compartments for removal.

A linearly extendible carriage is moveable along a track carried along a longitudinal side of the commodity collection truck. One or more refuse bin mounts are carried on the carriage to which may be detachably mounted individual refuse bins such as those found in industrial and commercial locations. The bin mounts can be moved along the length of the track into proper alignment with the individual commodity storage bins depending on the contents of the individual refuse bins. The carriage may be extended rearward from the collection truck and raised to reach over the deck of an elevated loading dock where refuse bins are stationed. The individual refuse bins can then be attached to the bin mounts carried on the carriage and the carriage may then be moved forward, into position alongside the desired storage compartment, where the carriage with the attached refuse bin or bins may then be raised to invert the individual refuse bins over the appropriate commodity storage compartment located on the collection truck.

The carriage is moved along the track by a hydraulic motor or equivalent driver and the tipping of the attached refuse bins may be effectuated with linkage included in the pivoting arms which move the carriage upward, or the tipping may be operated by individual hydraulic cylinders which may maintain the refuse bins in a generally upright orientation until they and the carriage are located over the storage compartment intended to receive the contents of the refuse bin.

In one embodiment of the invention, the carriage carries multiple refuse bin mounts to enable the operator to attach multiple bins with each bin containing a particular type of waste commodity, e.g. plastic recyclables, paper recyclables, organics and general trash. In this embodiment, the operator may attach the plastic collection bins in the relative order of the arrangement in the series of individual storage compartments on the collection truck, and then the carriage moves the individual collection bins into alignment alongside the appropriate storage compartment, such that all of the collection bins can be emptied at once, but with the differing types of commodities falling into the proper storage compartment on the truck.

In another embodiment, the collection body includes low profile storage compartments and the tipping apparatus and carriage is designed to permit emptying of the collection bins without exceeding a height of twelve and one half feet above ground level. A collection truck so equipped is very useful in older commercial environments where overhead utility wires may limit the height at which the refuse bins can be raised, and which make the traditional front loading or side loading commodity collection trucks inconvenient or impossible to use.

In a third embodiment, the lifting apparatus is equipped with a hydraulic piston which serves to upend the refuse bin attached to the carriage only when it is located at the proper height for emptying into the proper storage compartment on the collection truck.

It is a primary object of this invention to provide an improved commodity collection truck which allows automated retrieval of collection bins from elevated loading docks or from locations behind the collection truck.

It is another object of the invention to provide a commercial commodity collection truck which allows automated emptying of individual collection bins into appropriate ones of the storage compartments carried on the collection truck.

It is a further object of this invention to provide a commodity collection truck which can automatically load commodities from individual collection bins located along narrow alleyways and tight spaces.

It is yet a further object of this invention to provide a commodity collection truck which may safely maneuver and collect multiple types of commodities in spaces where limited overhead clearance is available.

These and other objects of the invention will become evident from examination of the detailed description which follows.

DETAILED DESCRIPTION OF THE INVENTION

Throughout this specification and the claims, the term "commodity" shall mean refuse and recyclable waste goods.

Figure 1:
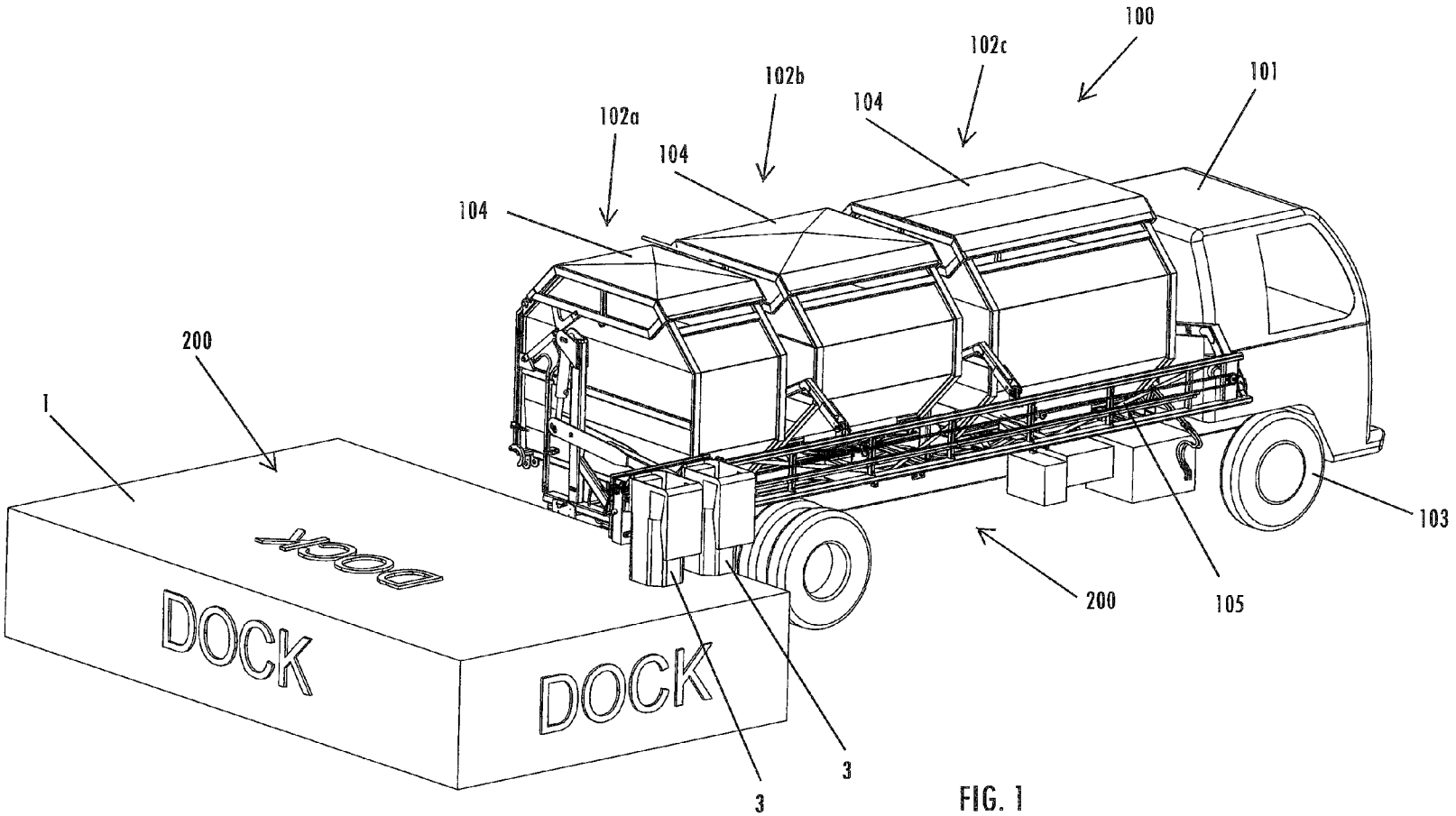
FIG. 1 is a perspective view of a refuse collection truck equipped with a collection mechanism according to the invention, with individual commodity bins attached to the carriage of the invention.
Figure 2:
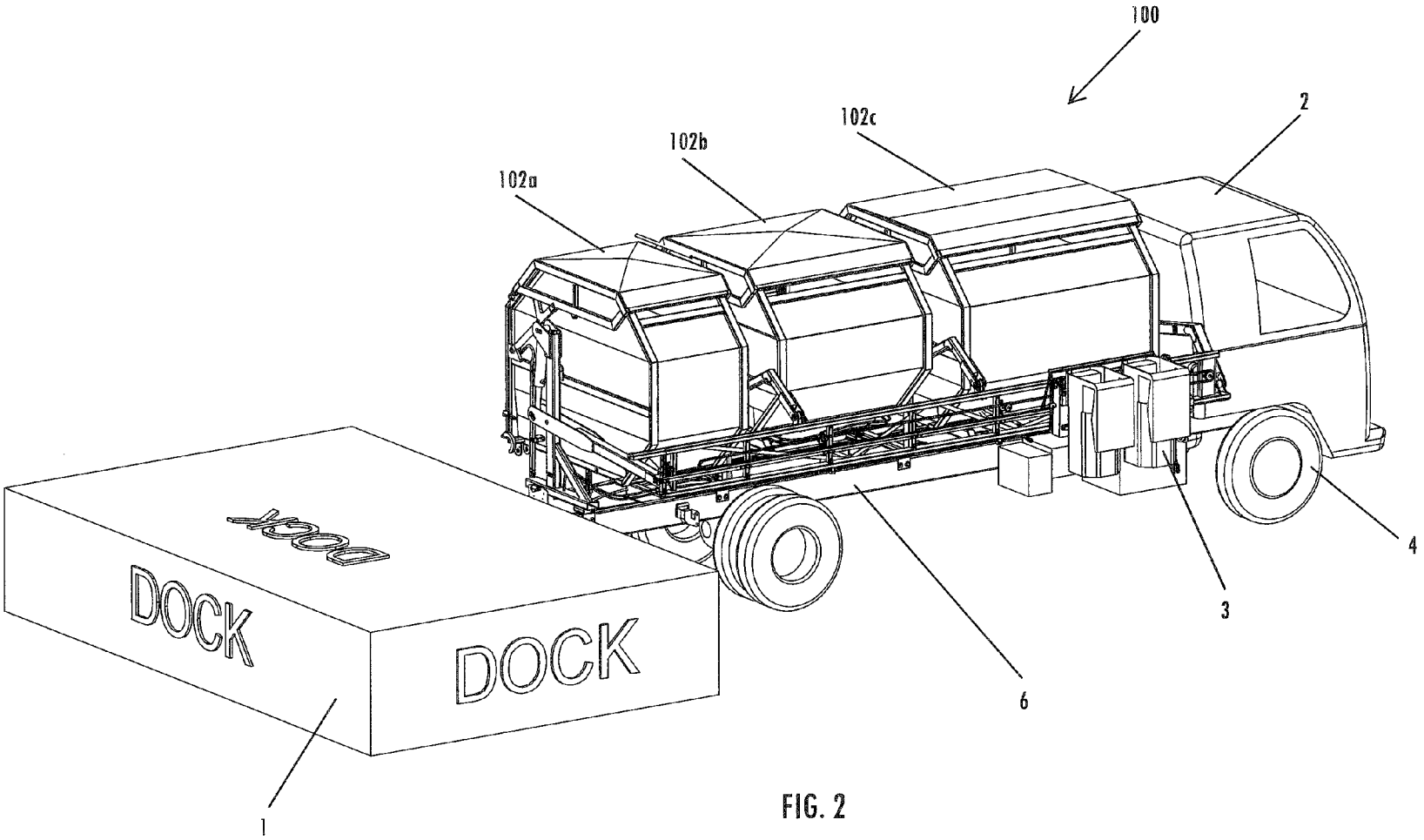
FIG. 2 is a perspective view of the refuse collection truck of FIG. 1 shown with the carriage carrying the commodity bins moved into position alongside the forwardmost storage compartment of the vehicle.
Figure 3:
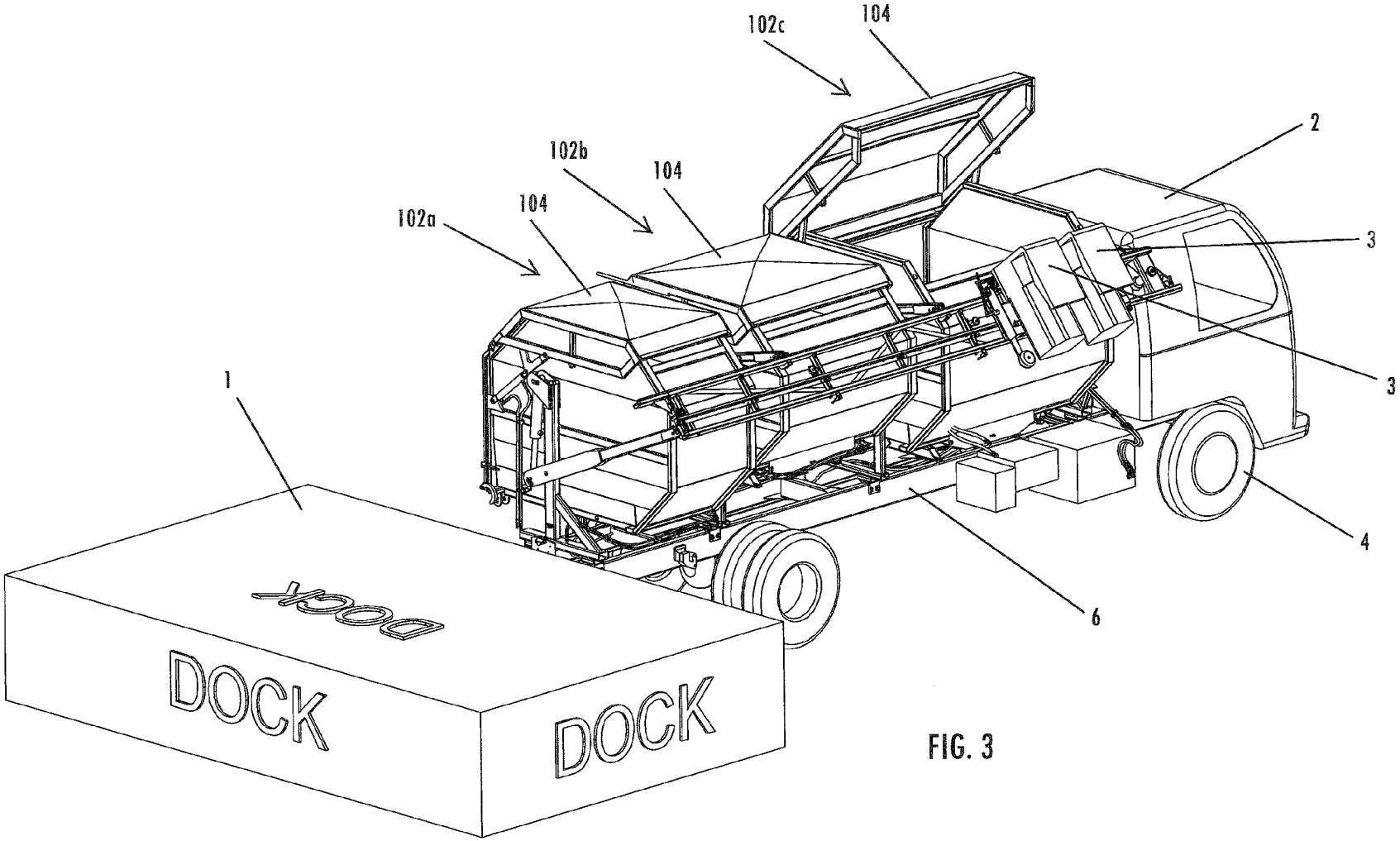
FIG. 3 is a perspective view of the vehicle of FIG. 1 shown with the invention partly raised.
Figure 4:
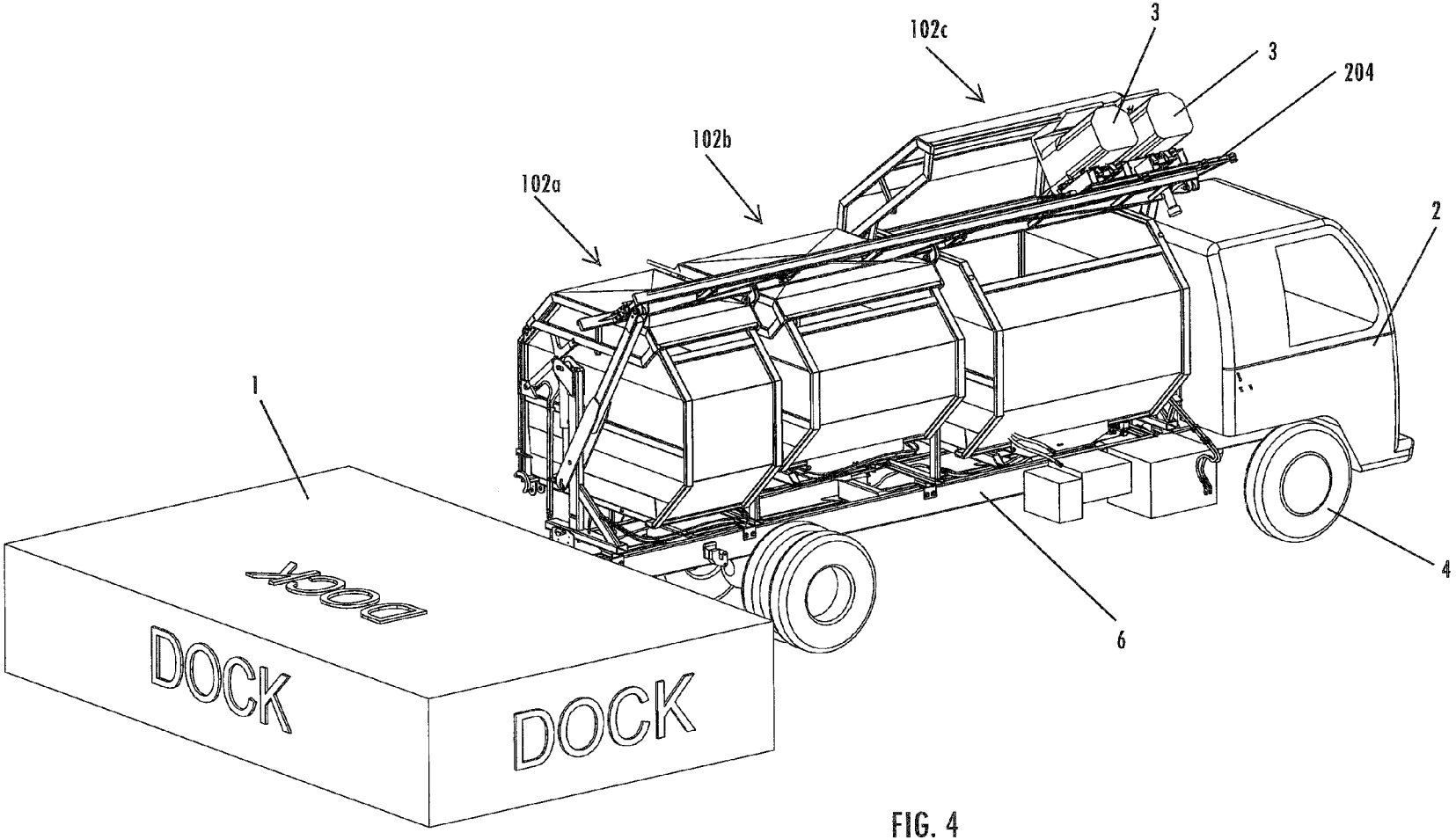
FIG. 4 is a perspective view of the vehicle of FIG. 1 shown with the invention fully raised, tipping the individual commodity bins over the selected forwardmost storage container of the vehicle.
Figure 5:
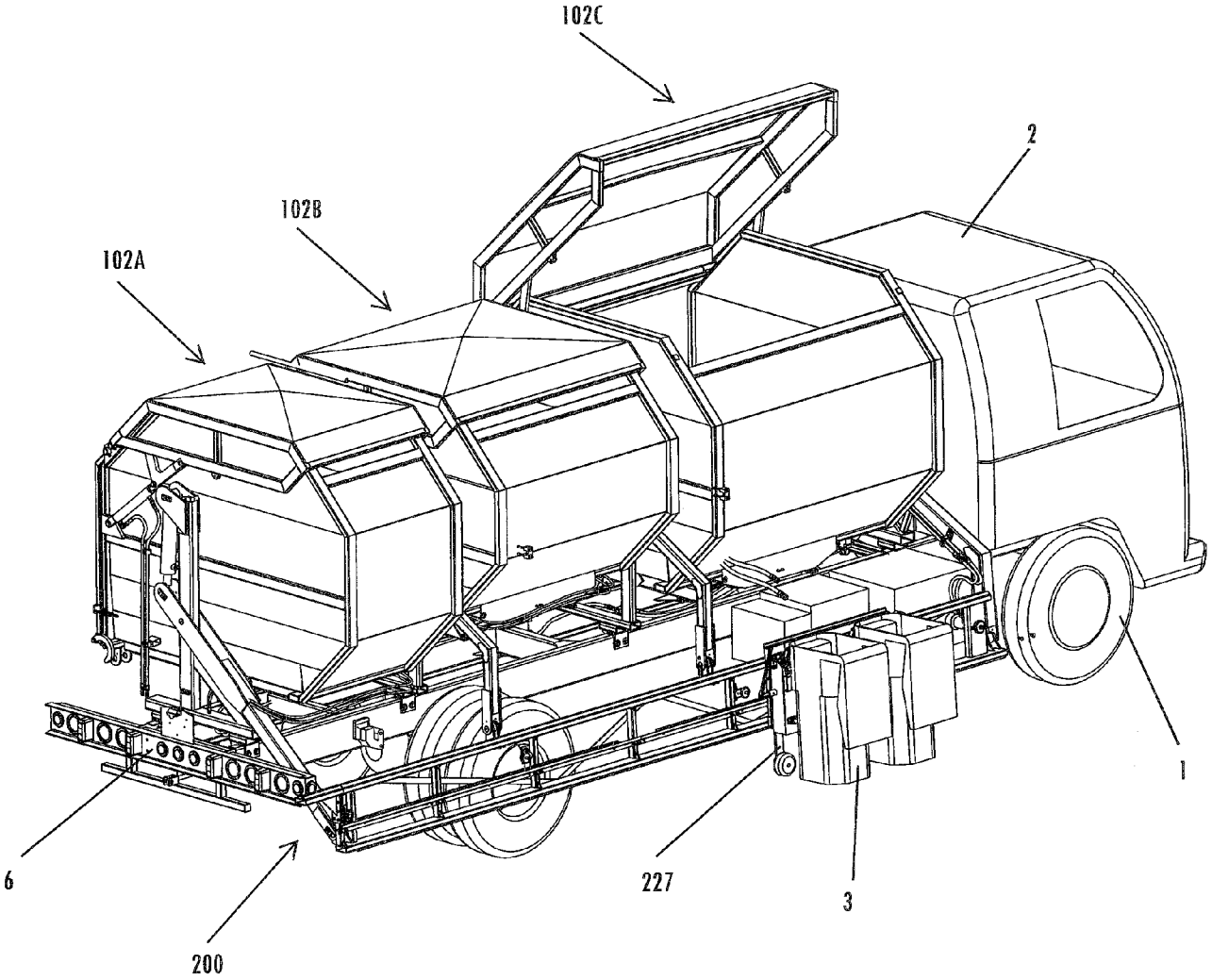
FIG. 5 is a perspective view of the vehicle of FIG. 1 with the invention collection mechanism lowered to place individual commodity bins on the ground.

FIGS. 1-5 illustrate an exemplary linearly extendable collection mechanism 200 attached to a refuse collection vehicle 100. Linearly extendable collection mechanism 200 quickens the collection of singular or plural mobile refuse bins and containers 3 by extending rearwardly from collection vehicle 100 to a position such as over a dock 1 where singular or plural container(s) 3 are positioned waiting to be emptied. Container(s) 3 are attached to linearly extendable collection mechanism 200, which moves the container 3 alongside the vehicle 100 and then raises and empties container(s) 3 into selected corresponding collection chambers 102*a, b*, and *c* on collection vehicle 100, as shown in FIG. 4.

Refuse collection vehicle 100 includes a cab 101 and wheels 103 connected to and supported on a chassis or frame 105 which carries collection chambers 102. Each collection chamber 102*a, b*, and *c* is topped by a cover 104 that is hydraulically or pneumatically raised as linearly extendable collection mechanism 200 raises containers 3 upward for unloading the bins of commodity into a selected collection chamber 102.

Figures 6, 7:
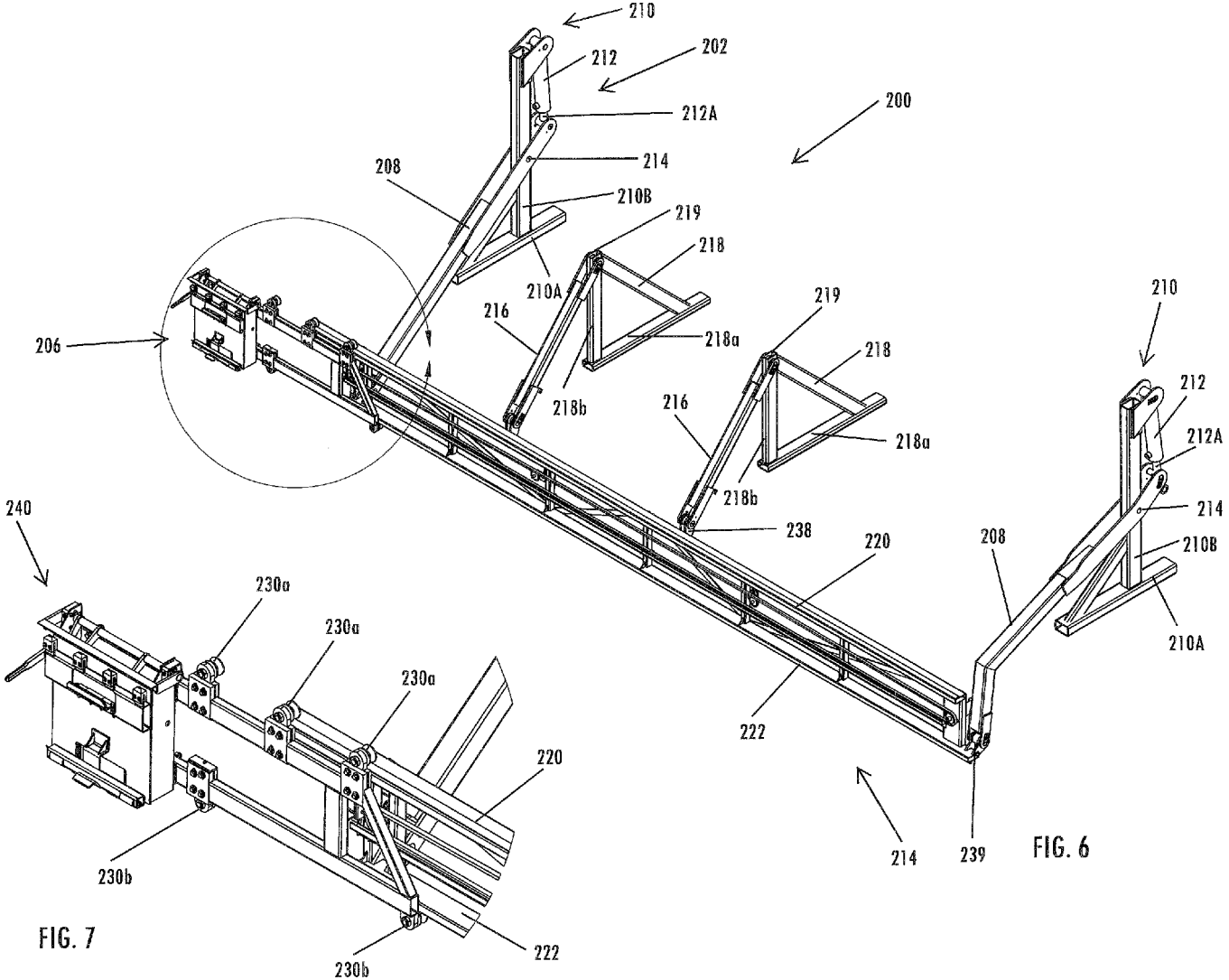
FIG. 6 is a perspective view of the collection mechanism according to the present invention, shown isolated from the refuse collection vehicle, and equipped with a single bin attachment mechanism on the carriage of the collection mechanism.
FIG. 7 is an enlarged perspective view of the carriage shown in FIG. 6.

Referring now to FIG. 6, linearly extendable collection mechanism 200 is illustrated apart from collection vehicle 100. Linearly extendable collection mechanism 200 includes three primary mechanisms: lifting mechanism 202, track 204, and carriage 206. This embodiment of carriage 206 is a first preferred embodiment with a single container attachment assembly 240. In an alternative embodiment of carriage 206 illustrated in FIGS. 1-5 and 16, two container attachment assemblies 240 are combined to an elongated carriage 206A.

Referring first to lifting mechanism 202, two hydraulically powered arms 208 are pivotally mounted to frame 105 of collection vehicle 100 and positioned on outer sides of collection chambers 102*a* and *c*, respectively. A cross stand 210 consisting of a horizontal bar 210*a* and a perpendicular bar 210*b* combines hydraulically powered arms 208 to frame 105 with a pivotally attached hydraulic cylinder 212 positioned therebetween. Hydraulic cylinders 212 each have a piston 212A attached to end of hydraulically powered arms 208. Hydraulically powered arms 208 are pivotally attached to perpendicular bar 210B at a fulcrum 214 and extend outward to track 204 where each is pivotally attached by pivot mounts 239.

Additional support for track 204 is provided by two or more passive arms 216 pivotally mounted to frame 6 of collection vehicle 100. In the case of a vehicle 100 with only two chambers 102*a, b*, only one passive arm 216 would be used. A triangular frame 218 is mounted at its base 218*a* to frame 105 of collection vehicle 100 on opposite sides of inner collection chamber 102*b*. Each passive arm 216 is pivotally attached to an upright side 218B of triangular frame 218 at a fulcrum 219. Passive arm 216 extends outward to track 204 where it is attached pivotally thereto at arm mounts 238.

In operation, lifting mechanism 202 raises and lowers linearly extendable collection mechanism 200 between a lowered position and any raised position between the lowered position and a fully raised, tipping position. In the lowered position, hydraulic cylinder 212 is retracted. As piston 212A of hydraulic cylinder 212 is extended downward, hydraulically powered arms 208 and passive arms 216 pivot upward about fulcrums 214 and 219, respectively. Upward movement of hydraulically powered arms 208 raises track 204 to the raised position. As hydraulically powered arms 208 reach their maximum height, track 204 pivots toward a partially inverted position by the linkage provided by passive arm 216, as shown in FIG. 4.

Figures 13, 14, 15:
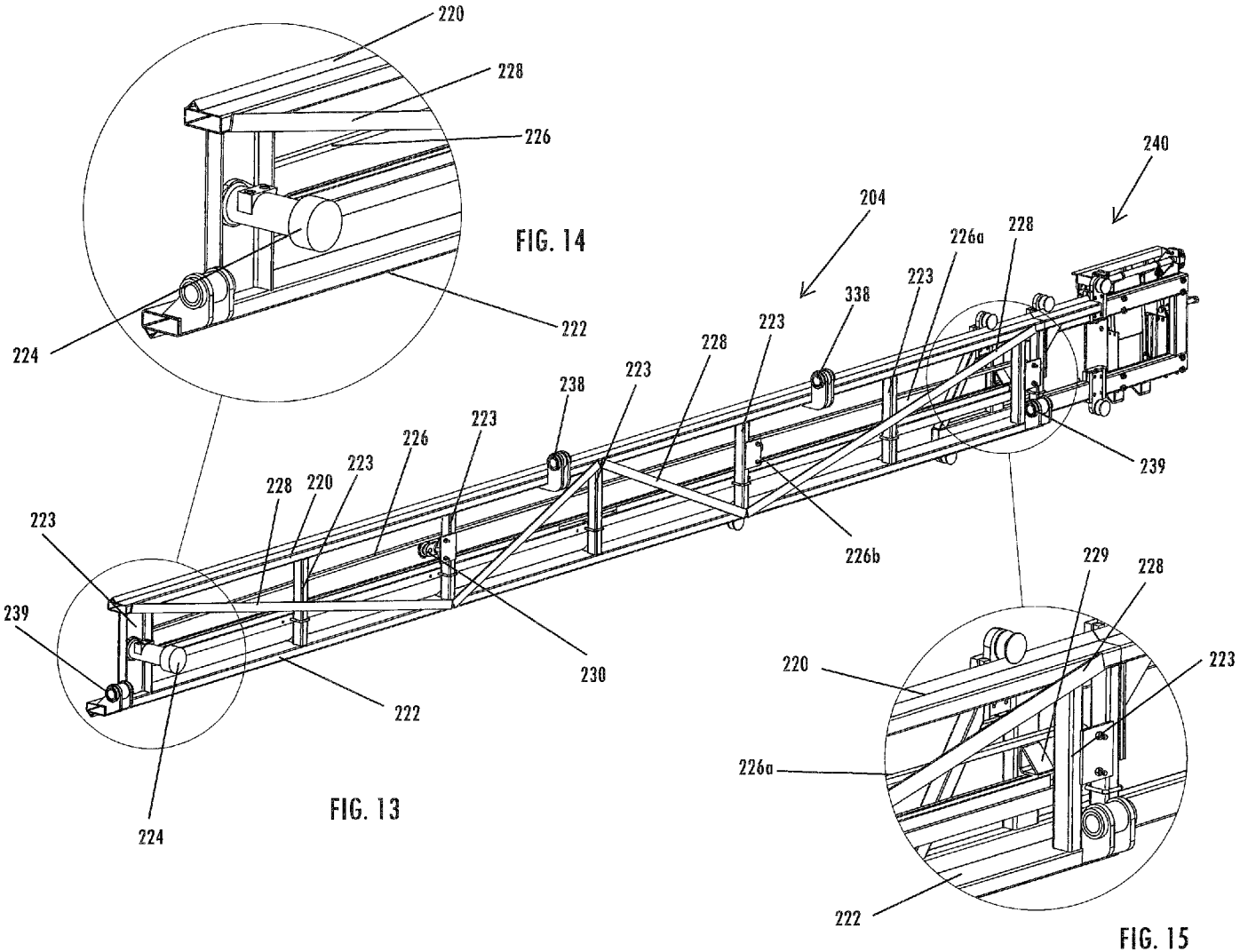
FIG. 13 is an enlarged perspective view of the rear side of the collection mechanism illustrated in FIG. 6, with the lifting arms omitted.
FIG. 14 is an enlarged perspective view of the proximal end of the track of FIG. 13 showing a drive motor mounted thereon.
FIG. 15 is an enlarged perspective view of the distal end of the track illustrated in FIG. 13

Turning now to FIGS. 13-15, track 204 is more clearly illustrated. Track 204 comprises an upper rail 220 and lower rail 222 joined to vertical support bars 223 and diagonal braces 228, the braces 228 interconnecting the vertical support bars 223 by connecting the upper end of one vertical support bar 223 to the bottom end of the next adjacent vertical support bar thereby creating a zig-zag pattern. A motor 224 (preferably a hydraulic motor) is supported on track 204 to drive a chain 226 in a path extending the longitudinal length of track 204. Chain 226 has upper and lower portions 226*a*, 226*b*, respectively, that travel back and forth from respective ends of track 204. Upper portion 226*a* is supported along its path of travel by one or more chain guides 230. Lower portion 226*b* travels uninterrupted between respective ends of track 204. A traveler 229 combines bottom portion 226*a* of chain 226 with carriage 206 to pull carriage 206 between respective ends of track 204.

Arm mounts 238 provide hinge connectors for passive arms 216. Pivot mounts 239 at opposing ends of track 204 provide hinge connectors for powered arms 208.

Figure 8:
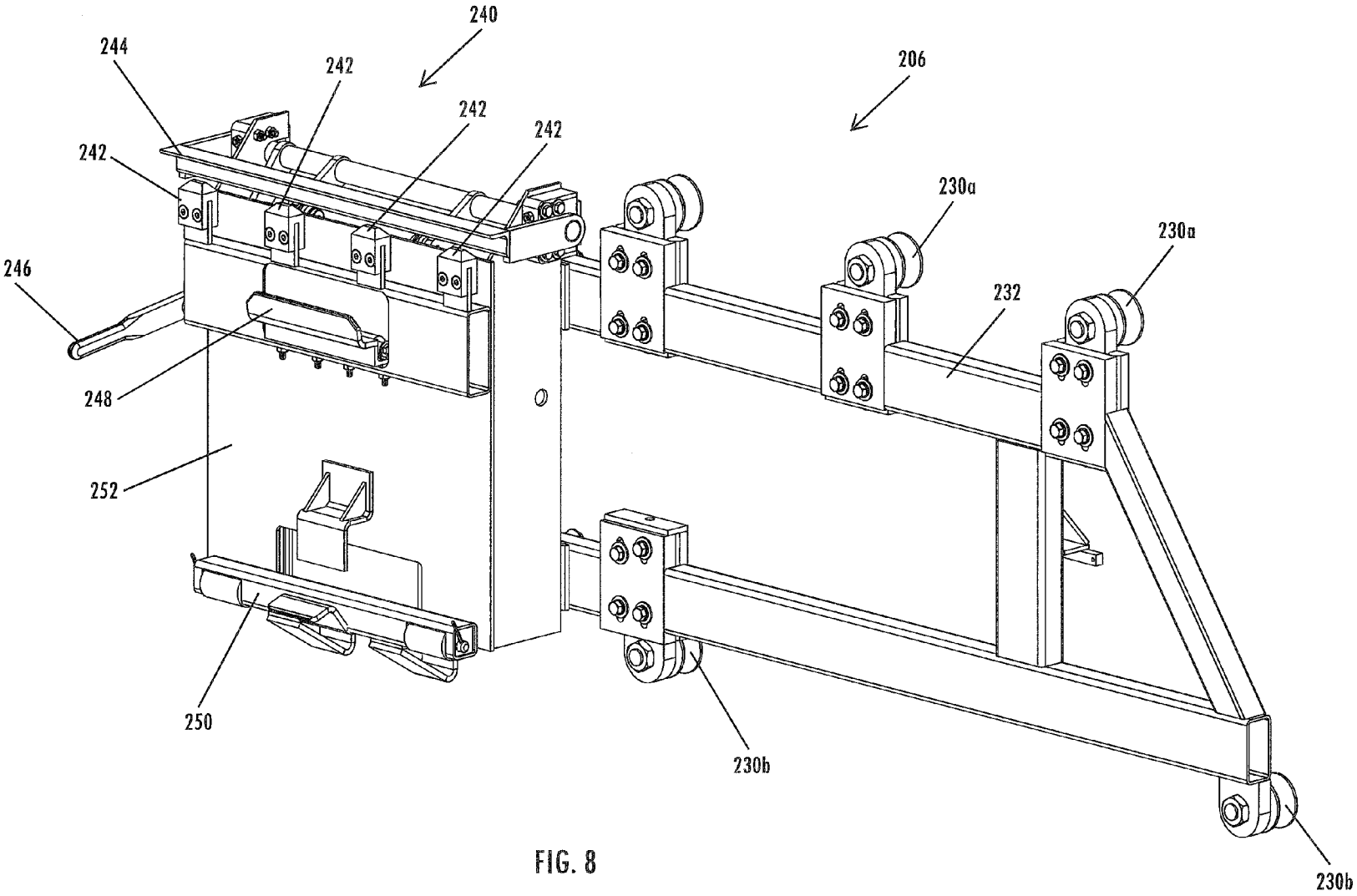
FIG. 8 is another enlarged perspective view of the carriage shown in FIG. 6.

Turning now to FIGS. 6-8, carriage 206 is more clearly illustrated. Carriage 206 travels back and forth across the length of track 204 and is supported on track 204 by a plurality of upper and lower rollers 230*a*, 230*b*, respectively, that engage upper and lower rails 220, 222, respectively. Upper and lower rollers 230*a*, 230*b* are spaced apart and supported by the carriage 206. Attached to carriage 206 is container attachment assembly 240.

Figure 16:
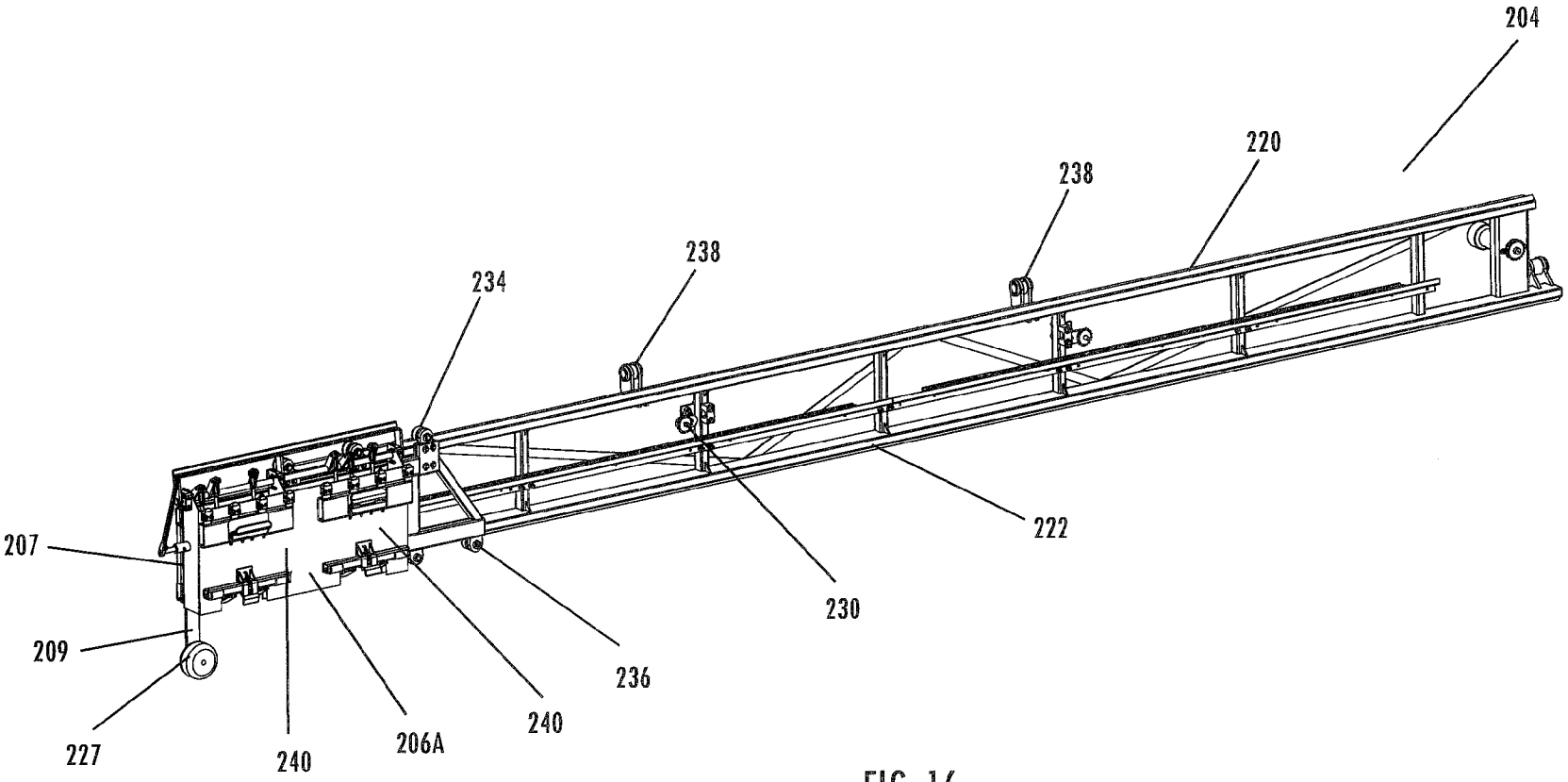
FIG. 16 is an enlarged perspective view of the track and carriage of the collection mechanism of the collection vehicle of FIG. 1, having two container attachment mechanisms attached thereto.

While FIGS. 6-8, 14-15 depict one preferred embodiment with a single container attachment assembly 240 attached to carriage 206, an alternative embodiment of carriage, namely carriage 206A is illustrated in FIG. 16. FIG. 16 shows that carriage 206A is elongated and may extend up to the length of track 204 (or any intermediate length) to accommodate a plurality of container attachment assemblies 240. The alternative embodiment of carriage 206A is also supported on track 204 by the plurality of upper and lower rollers 234, 236, respectively, that engage upper and lower rails 220, 222, respectively. Upper and lower rollers 234, 236 are spaced apart and supported on carriage 206A. Attached to frame 232 are two container attachment assemblies 240 though other multiples of container attachment assemblies 240 might be mounted to carriage 206A, limited mainly by the length of frame 232 and the number of chambers 102 on the collection vehicle 100.

Returning attention to FIGS. 1-5, two containers 3 are shown combined to linearly extendable collection mechanism 200 with each commodity container 3 being combined thereto by a corresponding number of container attachment assemblies 240. To support the free end 207 of the carriage 206, a vertical leg 225 terminating in the stabilizing wheel 227 is mounted at the free end 207 of carriage 204. A biasing mechanism, such as a spring or shock absorber keeps the stabilizing wheel 227 engaged with dock 1.

Referring back to FIG. 8, container attachment assembly 240 generally comprises a plurality of tines 242, a lock 244 selectively engageable to commodity container 3 by a lever 246, and upper and lower selectively extendable spring loaded latches 248, 250, respectively, mounted on a box 252 combined to carriage 206.

Figure 10:
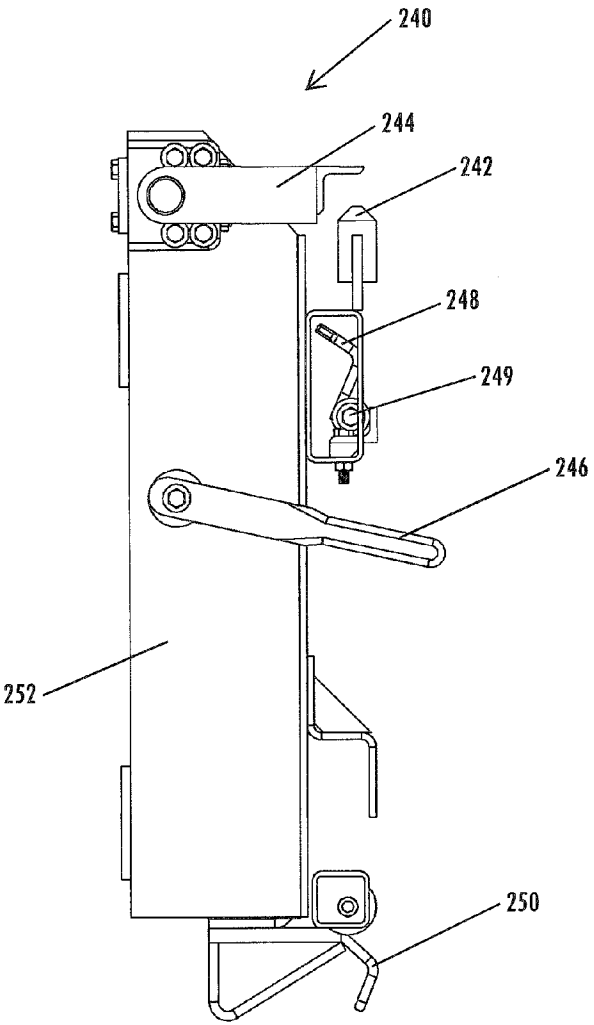
FIG. 10 is a side view of the bin attachment mechanism shown in FIG. 8 with the spring loaded latches folded back and a lever in the engagement position to secure a European style container to the attachment assembly.
Figure 9:
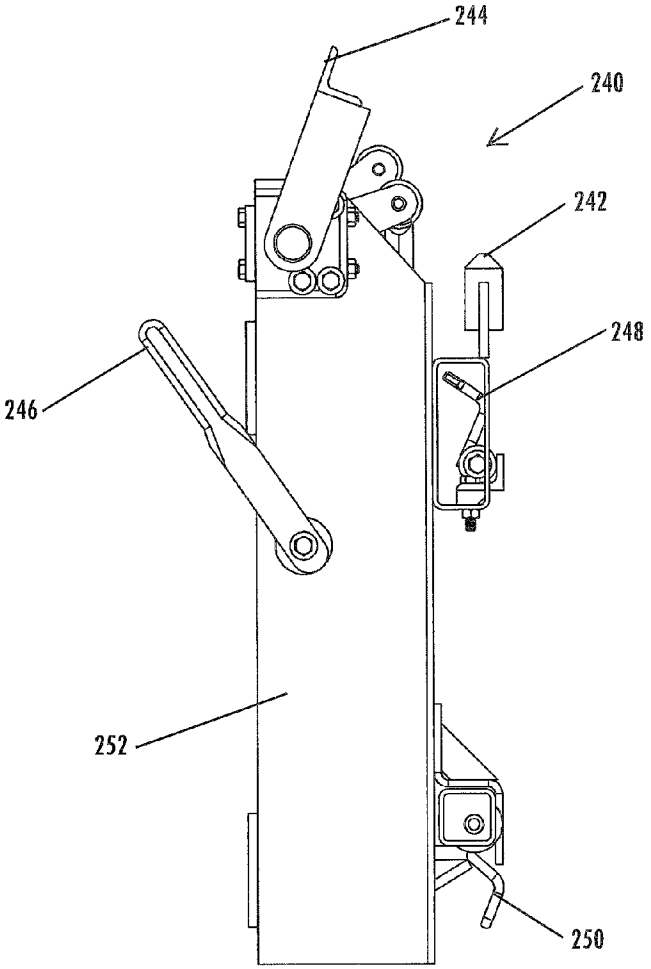
FIG. 9 is a side view of the bin attachment mechanism shown in FIG. 8 with the spring loaded latches folded back to receive a European style container.

FIGS. 9 and 10 illustrate a side view of container attachment assembly 240 with upper selectively extendable spring loaded latch 248 folded away. Because European style containers have a plurality of pockets (not shown) adapted to receive tines 242, this configuration is intended for securing and holding European style containers 3. When a European style container is in position, with tines 242 aligned with corresponding pockets on European style container 3, lever 246 is drawn downward to engage lock 244 over the top of commodity container 3 in order to secure commodity container 3 to container attachment assembly 240.

Figure 12:
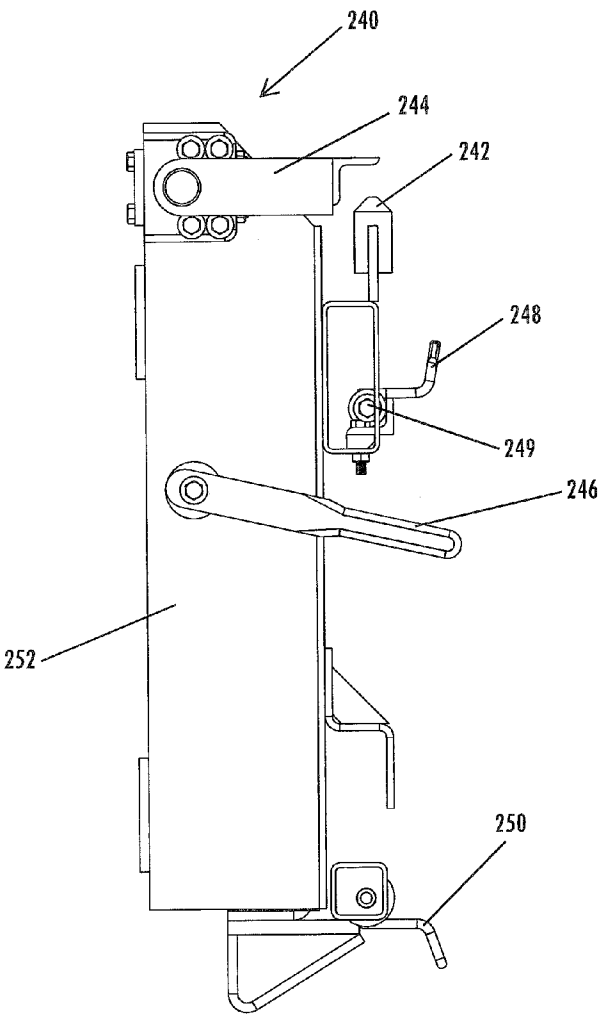
FIG. 12 is a side view of the bin attachment mechanism shown in FIG. 8 with the spring loaded latches folded outward and a lever in the engagement position to secure a U.S. style container to the attachment assembly.
Figure 11:
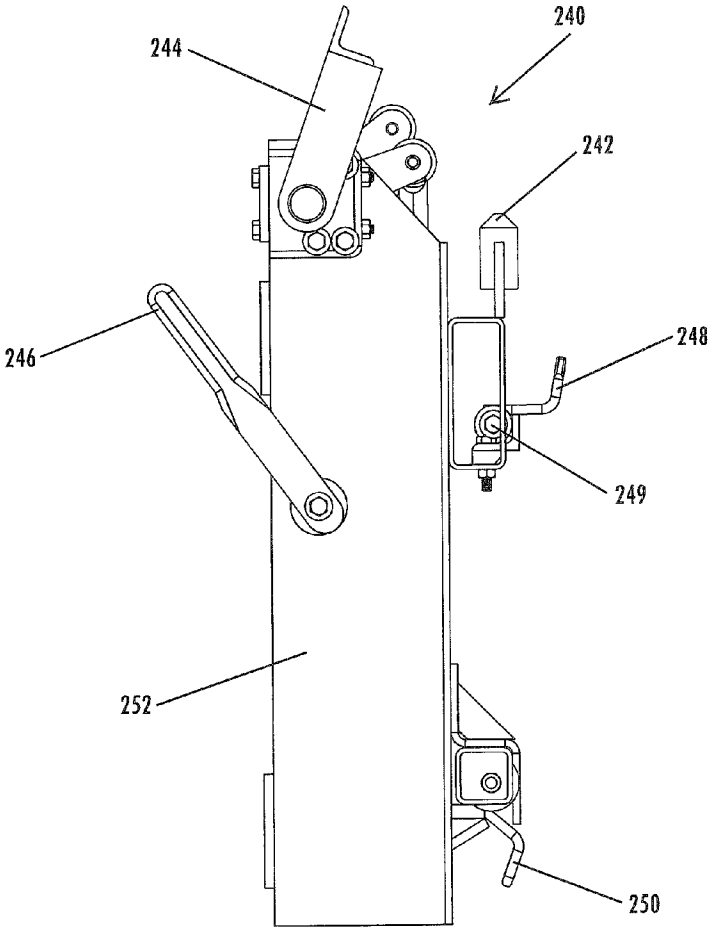
FIG. 11 is a side view of the bin attachment mechanism shown in FIG. 8 with the spring loaded latches folded outward to receive a U.S. style container.

FIGS. 11 and 12 illustrate a side view of container attachment assembly 240 with selectively extendable spring loaded latch 248 folded outward. Spring loaded latch 248 is rotatably mounted to container attachment assembly 240 on a pin 29 beneath tines 242. This configuration is intended for securing and holding U.S. style containers 3. U.S. style containers have an upper and a lower bar (not shown) that extend outward and are adapted to receive upper and lower spring loaded latches 248, 250. When a U.S. style container is in position with its bars aligned with upper and lower spring loaded latches 248, 250, lever 246 is drawn downward to extend lower spring loaded latch 250 outward to lock lower bar of commodity container 3 to container attachment assembly 240. In this configuration, lock 244 and tines 242 are not used and their position on box 252 keeps them out of the way.

Extension and retraction of carriage 206 and elevation of track 204 may be effected by use of a wireless remote control carried by the operator. A second control panel to cause extension and retraction of carriage 206 and its elevation into the dumping position may be located in cab 2 of refuse collection vehicle 100.

In another embodiment, the present invention also provides a low profile waste commodity collection body 2 mounted on a truck chassis 4, the truck chassis 4 having a frame height of about thirty-eight inches. The body 2 comprises multiple hoppers 6, 8, each having a moveable cover 16, 18. In the embodiment of FIGS. 17-22, two hoppers 6, 8 are illustrated but it should be understood that more than two hoppers may be included as part of body 2 and that the capacity of hopper 8 may differ from the capacity of the other hopper 6 by differences in the height or end-to-end width of the hopper, or the hoppers 6, 8 may be identical in size and shape if desired.

It is preferable that the tops 24, 26 of hoppers 6, 8 be at approximately the same elevation on chassis 4. Because hopper 6 is shorter than hopper 8, it is raised by its lift apparatus 32 and maintained there so that the tops 24, 26 of hoppers 6, 8 are at the same height.

Figure 17:
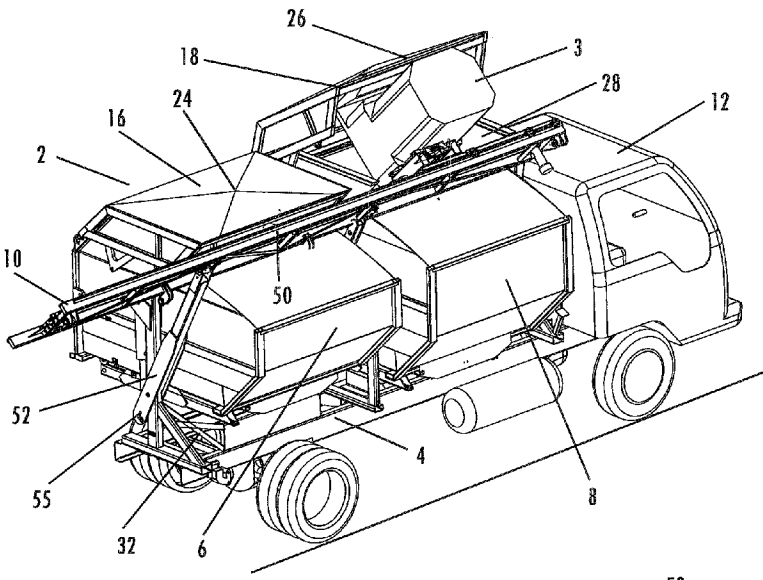
FIG. 17 is a perspective view of a low profile refuse collection truck according to another embodiment of the invention, with the collection mechanism shown emptying the contents of a refuse bin into the front hopper of the collection truck.
Figure 18:
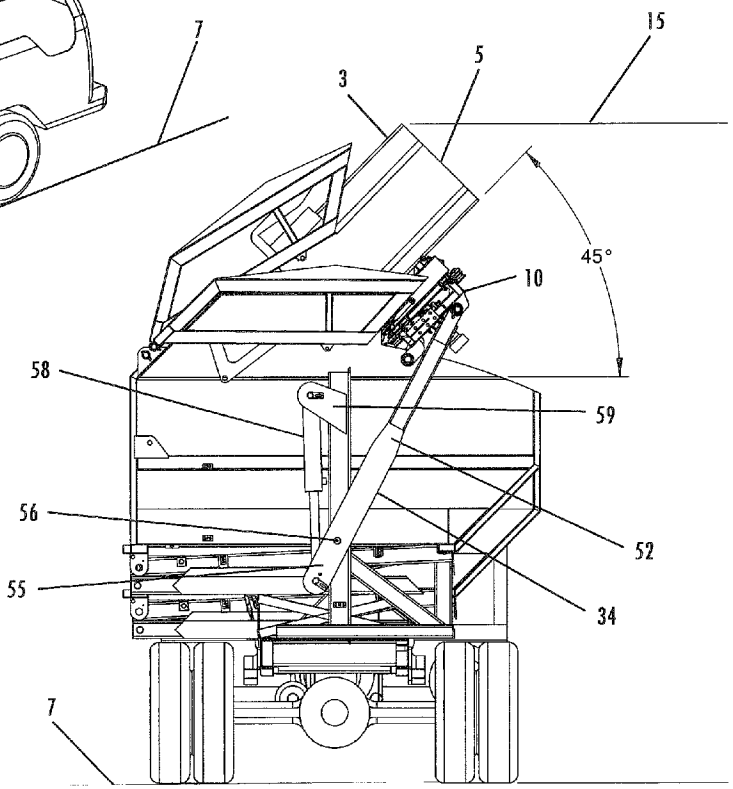
FIG. 18 is a rear elevation of the refuse collection truck of FIG. 17.
Figure 20:
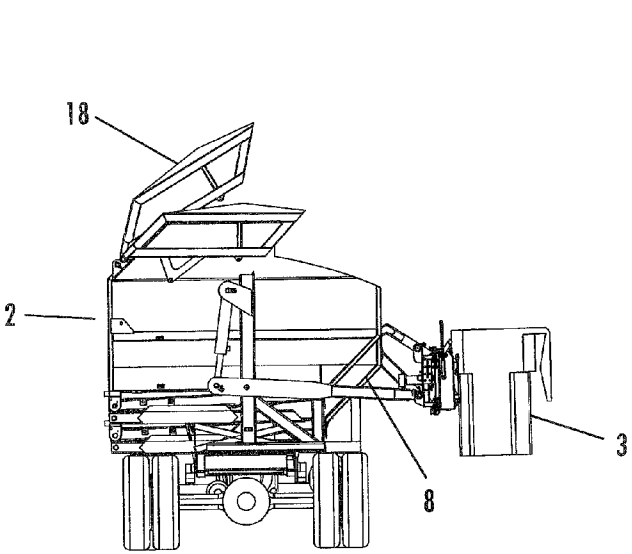
FIG. 20 is a rear elevation of the refuse collection truck of FIG. 18 showing the refuse container attached to the collection mechanism and raised above the ground surface.
Figure 19:
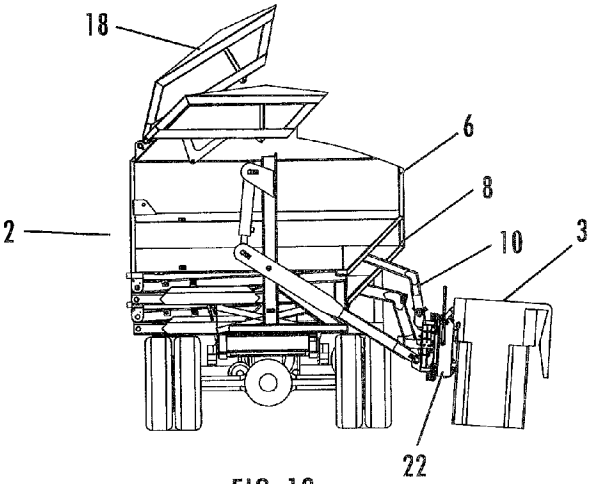
FIG. 19 is a rear elevation of the refuse collection truck of FIG. 18 showing a refuse container attached to the collection mechanism ready to be lifted for tipping and emptying into the front hopper on the collection body.
Figure 21:
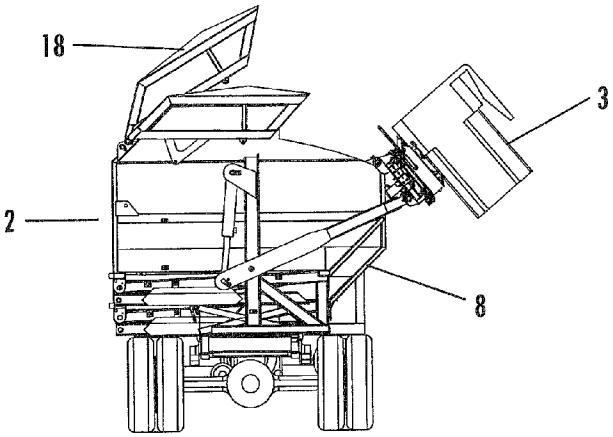
FIG. 21 is a rear elevation of the refuse collection truck of FIG. 18 showing the refuse container attached to the collection mechanism and beginning to tip toward the load opening of the hopper.

The hoppers 6, 8 may be independently or simultaneously loaded from individual refuse containers such as container 3 which is shown in FIG. 17 as it is tipped to empty its contents by gravity into hopper 8. The loading operation is accomplished by a selectively moveable bail assembly 10 which is moveable from a lowered position beside body 2 as seen in FIG. 19. In the lowered position of bail assembly 10, refuse container 3 may be hooked to a mounting plate 22 which locks container 3 to bail assembly 10 so that container 3 will not drop into hopper 8 when it is inverted over the load opening 28 of hopper 8.

Bail assembly 10 comprises longitudinal rail 50 which extends at least along the length of hoppers 6, 8 and is raised by pivot arms 52 at each end of body 2. A guide arm 54 located between hoppers 6 and 8 stabilizes bail 10 as it is raised to the dumping position above top walls 62, 82 of hoppers 6, 8. Pivot arms 52 and guide arm 54 pivot about a longitudinal axis 56 substantially centered horizontally on chassis 4 and disposed at or just under the floors 69, 89 of hoppers 6, 8. The pivot arm 52 extends past pivot axis 56 to provide a lever arm 55 which is operatively connected to a vertically oriented drive cylinder 58 which is supported on a vertical beam 59 which is supported on chassis 4. An identical arm and pivot structure is provided at the front end of body 2 and the hydraulic drive cylinders 58 extend and retract under control of an operator such that refuse container 3 positioned alongside the selected hoppers 6, 8 and attached to mounting plate 22 can be raised to a dumping position above the hopper 6 or 8. As bail assembly 10 is raised, linkage connecting mounting plate 22 to rail 50 causes mounting plate 22 to rotate container 3 about a 135° arc such that container 3 is substantially inverted when it reaches the dumping position over load opening 28 of hopper 8. As the bail assembly 10 is raised, another hydraulic cylinder causes cover 18 to raise, allowing access to load opening 28.

Hoppers 6, 8 are specifically constructed so that the body 2 mounted on a standard truck chassis 4 of thirty-eight inch height is short enough that covers 16, 18 may be raised to permit 135° tipping of a refuse container 3 into load opening 28 such that the bottom 5 of container 3 does not extend above height 15 which is not more than twelve feet, six inches above the ground surface 7 on which the truck chassis 4 rests.

When raised maximally, covers 16, 18 rise only about 25° above horizontal, yet access to load opening 28 is afforded by gap 86 and between wall extensions 81 and 83.

The profile of hoppers 6, 8 permits the container 3 to be dumped there into without requiring a vertical clearance in excess of twelve feet, six inches so that recycling refuse body 2 may be parked below building roofs when it is positioned to receive refuse container 3 and to dump the container 3 into one of hoppers 6, 8.

Figure 22:
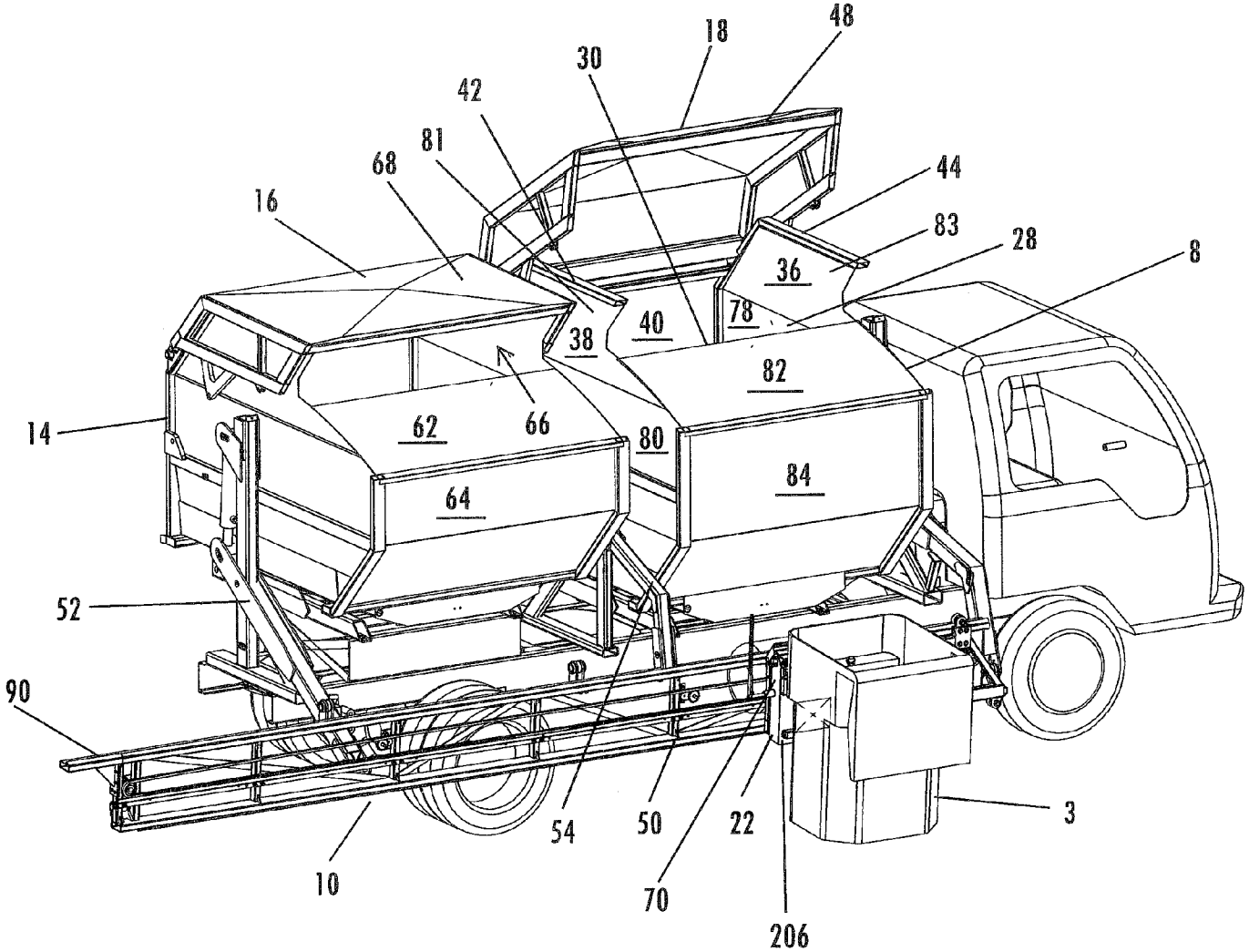
FIG. 22 is a side perspective of the refuse body according to the present invention, with the collection mechanism in its fully lowered position and with a refuse container attached thereto.

Referring now particularly to FIG. 22, hopper 8 comprises a top wall 82 which adjoins load opening 28 and partially defines load opening 28 by its free edge 30. Top wall 82 adjoins a substantially vertical first side wall panel 84 at an angle of about 70-75° such that top wall 82 inclines from its junction with first sidewall 84 at about 15-20° above horizontal. Extending upward from opposing ends of load opening 28 are front end wall extension 81 and rear end wall extension 83 which rise above end walls 78, 80, terminating in ledges 42, 44 which provide rest surfaces for the underside of the roof 48 of cover 18. When cover 18 is closed and resting on ledges 42, 44, a gap 86 is defined between roof 48 and top wall 82. Gap 86 is open horizontally into the space between end wall extensions 81, 83 when cover 18 is lowered. By reference to closed hopper 6 in FIG. 22, one can observe gap 66 between roof 68 of cover 16 and top wall 62 of hopper 6.

FIG. 22 illustrates that bail assembly 10 includes a rail extension 90 which allows carriage 206 to be selectively moved longitudinally along rail 50 to extend rearward from the rear end 14 of body 2. This structure is described in more detail in preceding paragraphs and provisional patent application Ser. No. 61/451,777 filed Mar. 11, 2011, which is incorporated by this reference. The extendible rail member 90 permits mounting plate 22 to be moved past the rear 14 of body 2 such that container 3 may be fastened to mounting plate 22 at a location behind body 2 and then moved along rail 50 to a position alongside the one of hoppers 6, 8 into which the container 3 is to be emptied. The rail extension 90 permits retrieval of containers 3 from within covered structures as well as from elevated locations behind the collection vehicle such as loading docks on which containers 3 may be placed.

Figure 23:
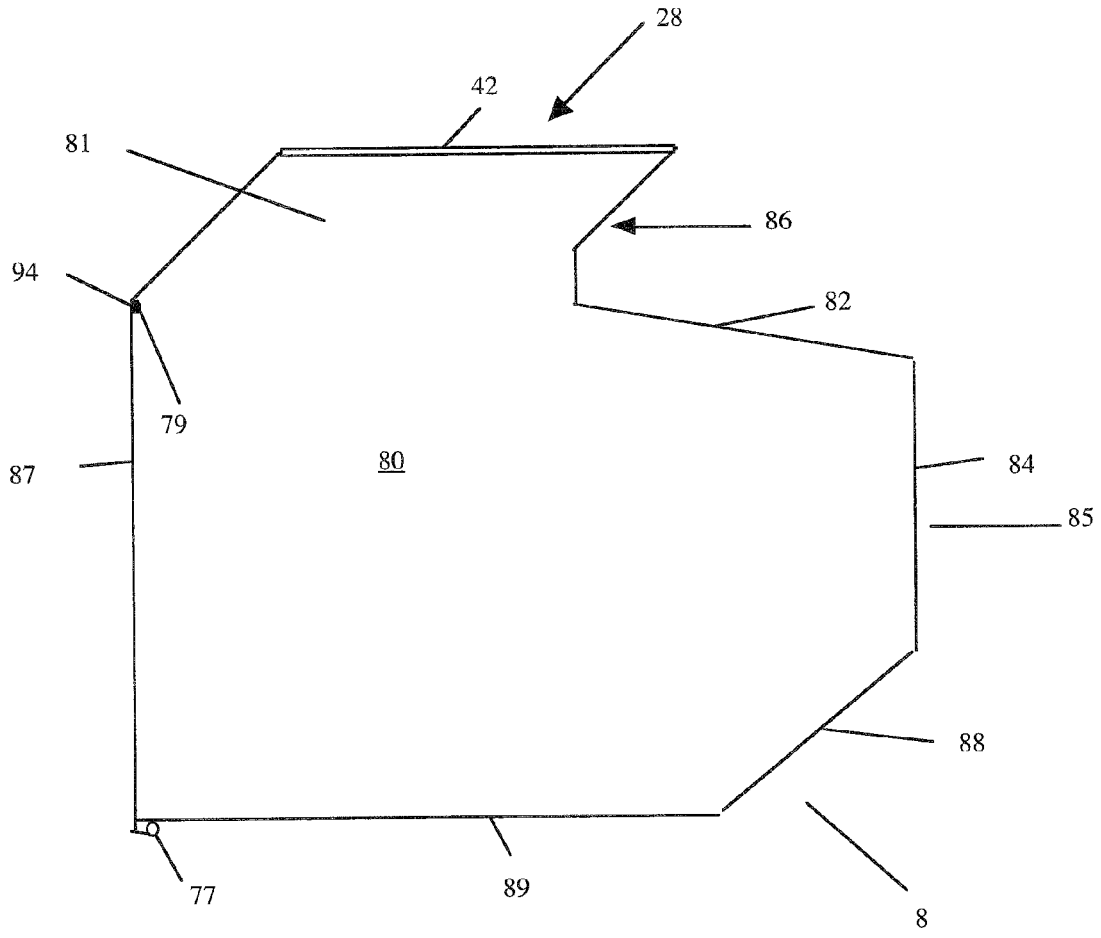
FIG. 23 is a rear elevation of an exemplary hopper of the refuse body of FIG. 18 shown with its cover omitted.

Referring to FIG. 23 particularly, it can be seen that hopper 8 comprises a first side wall 87 which is hinged at its top 94 to front and rear end walls 78, 80 at hinge 79 and is selectively retained to floor 89 by moveable latch 77 until hopper 8 is to be emptied. First side wall 87 may be unlocked from floor 89 such that it will swing away from hopper 8 as hopper 8 is tipped toward to the left, that is, toward first side wall 87.

Rear wall 80 and opposing front wall 78 are generally parallel and identical in shape while opposing second side wall 85 does not reflect the planar configuration of first side wall 87. Second side wall 85 comprises a lower inclined wall panel 88 inclining upward from floor 89 to vertical wall panel 84 to which it is joined. A top wall 82 inclines from vertical wall panel 84 to end wall extension 81.

A floor 89 joins the end walls 78, 80 and the lower inclined wall panel 88.

The interior of hopper 8 is partially covered by top wall 82 which is secured to the upper panel 88 of the second sidewall 85 and to each of the front and rear end walls 78, 80. Top wall 82 ends with free edge 30 which defines one end of the loading opening 28 which is recessed between wall extension regions 81, 83.

When cover 18 (omitted from FIG. 23) is lowered to rest on support ledge 42, a slanted opening at gap 86 remains into the interior of hopper 8. When the cover 18 is opened, bail assembly 10 is enabled to tip container 3 over load opening 28 without container 3 having to clear end wall extension 81.

Figure 25:
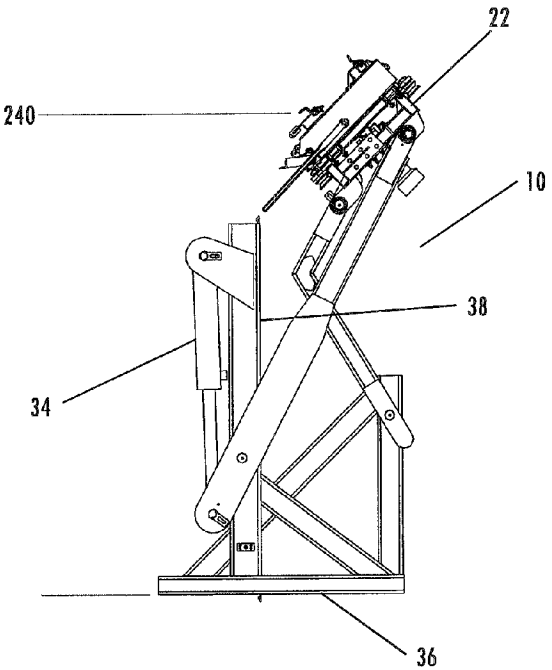
FIG. 25 is a rear elevation of the collection mechanism of FIG. 18 with the collection mechanism shown in isolation in the unloading position.
Figure 24:
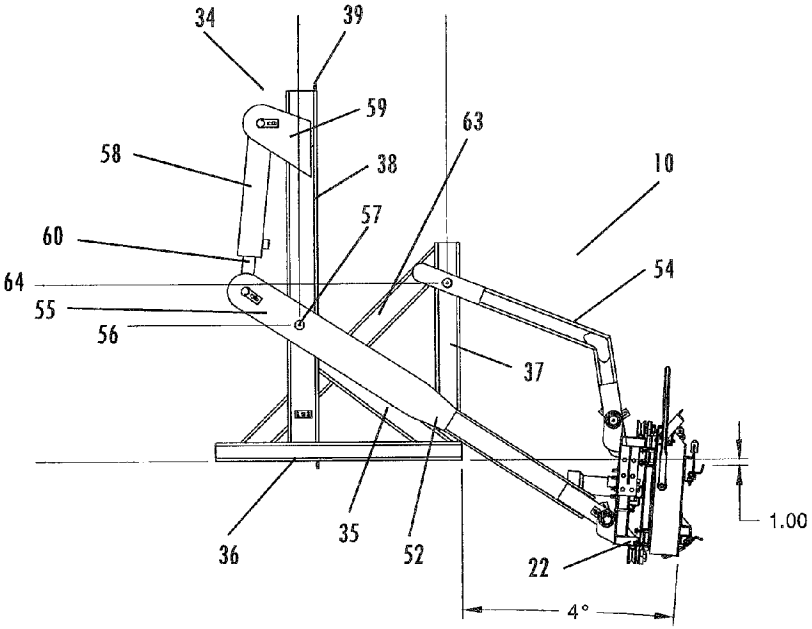
FIG. 24 is a rear elevation of the collection mechanism of the invention shown in isolation in the lowered position.

FIGS. 24, 25 illustrate the bail assembly 10 in the lowered position (FIG. 24) and in the unloading position (FIG. 25).

The bail assembly 10 of the invention of FIGS. 17-25 comprises front and rear lifting mechanisms, each equivalent to rear lifting mechanism 34 along with guide arm 54. Lift mechanism 34 comprises a base beam 36 which is securely mounted to the rear end 14 of body on chassis 4. A standard 38 upstands from base beam 36 and supports cylinder support beam 59 near its upper end 39. Standard 38 also provides a fulcrum for pivot arm 52 at pivot axle 57 which is generally coincident with the longitudinal axis 56 of body 2. Cylinder support beam 59 anchors drive cylinder 58 at the base thereof while cylinder rod 60 is hinged to lever arm 55 such that as cylinder rod 60 extends, pivot arm 52 is caused to rotate upwardly around pivot axle 57.

Guide arm 54 is disposed along bail 10 and mounted to chassis 4 between hopper.

A triangular upright base 63 mounts to chassis 4 and provides a pivot pin 64 about which guide arm 54 may passively rotate. Guide arm 54 is formed to provide linkage which mechanically rotates a refuse bin 3 attached to bin mounting plate 22 as pivot arm 52 raises the refuse bin 3, thereby guiding the refuse bin 3 to a substantially tipped position as it rises over the load opening 28 of hopper 8 or the corresponding load opening of hopper 6 if the carriage 70 has located the refuse bin 3 alongside hopper 6.

FIGS. 26-29 illustrate a third embodiment of a refuse collection vehicle which is equipped to retrieve individual refuse containing bins at ground level or from an elevated position. FIGS. 26-29 show a refuse collection truck 302 having a frame 304 supported on wheels 305. Collection truck 302 carries multiple hoppers 306, of which the rearmost hopper has been omitted in FIGS. 26-29. As a result of this omission, guide arm linkage 354 can be observed, such being otherwise obscured by a rearmost hopper.

Hopper 306 is supported on a modified scissors jack 332 which can be selectively operated to selectively elevate hopper 306 and to tip it toward its discharge wall 333 which releases from catch 334 such that discharge wall 333 can fall open because it is hinged at its top end 335. The contents of hopper 306 can be emptied into a container located alongside hopper 306 as discharge wall 333 swings open.

Figure 26:
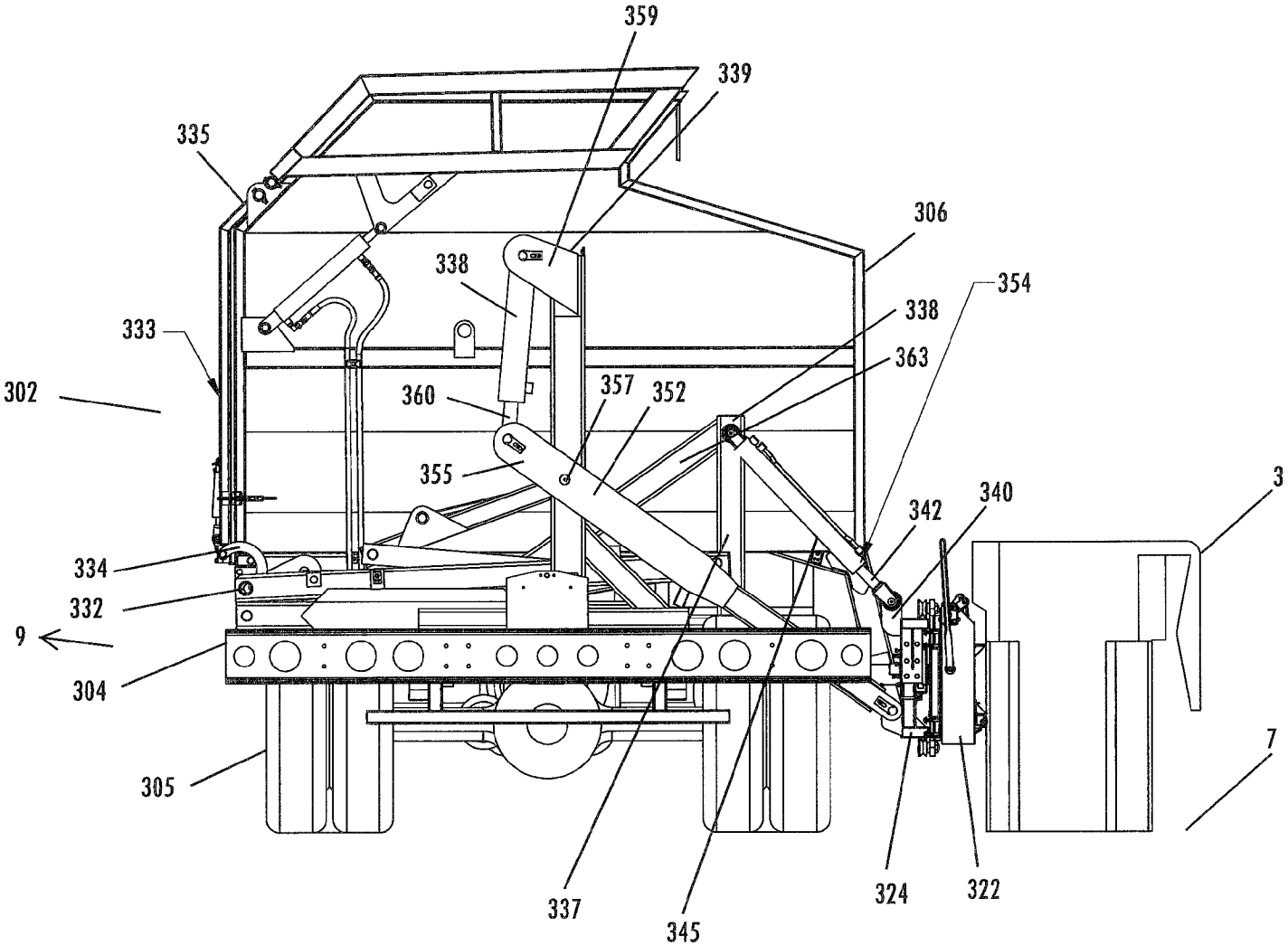
FIG. 26 is a rear view of a refuse collection truck with the rearmost hopper omitted, the collection truck equipped with another embodiment of the collection mechanism of the present invention.

FIG. 26 depicts a refuse bin 3 resting on ground 7 and latched to mounting plate 322 carried on bail assembly 310. Pivot arms 352 operate similarly to the powered arms 208 of FIG. 6, namely pivot arms 351 selectively pivot about pivot axle 357 which is generally laterally centered relative to hopper 306 and chassis 304 because vertical beam 338 extends generally perpendicularly upwardly from chassis 304. The upper end 339 of vertical beam 338 supports an offset arm 359 which locates drive cylinder 358 to the street side 9 of truck 302. The rod 360 of drive cylinder 358 is hinged to lever arm support 355 of pivot arm 352 such that pivot arm 352 can be caused to rotate around pivot axle 357 when rod 360 is extended.

It should be understood that track 204 is equivalent to the track 204 described in reference to FIGS. 1-16 above and references to the collection mechanism 200 of those figures is made.

Pivot arm 352 joins track 204 of bail assembly 310 and is hinged thereto. Mounting plate 322 is supported on track 204 and selectively moveable therealong to any desired position between the ends of track 204.

Guide arm linkage 354 comprises a vertical standard 337 which is mounted to and upstands on chassis 324. A brace 363 supports standard 337. A cylinder 355 links the upper end 338 of standard 337 with linkage member 340 which joins cylinder rod 342 to track 204.

Figure 27:
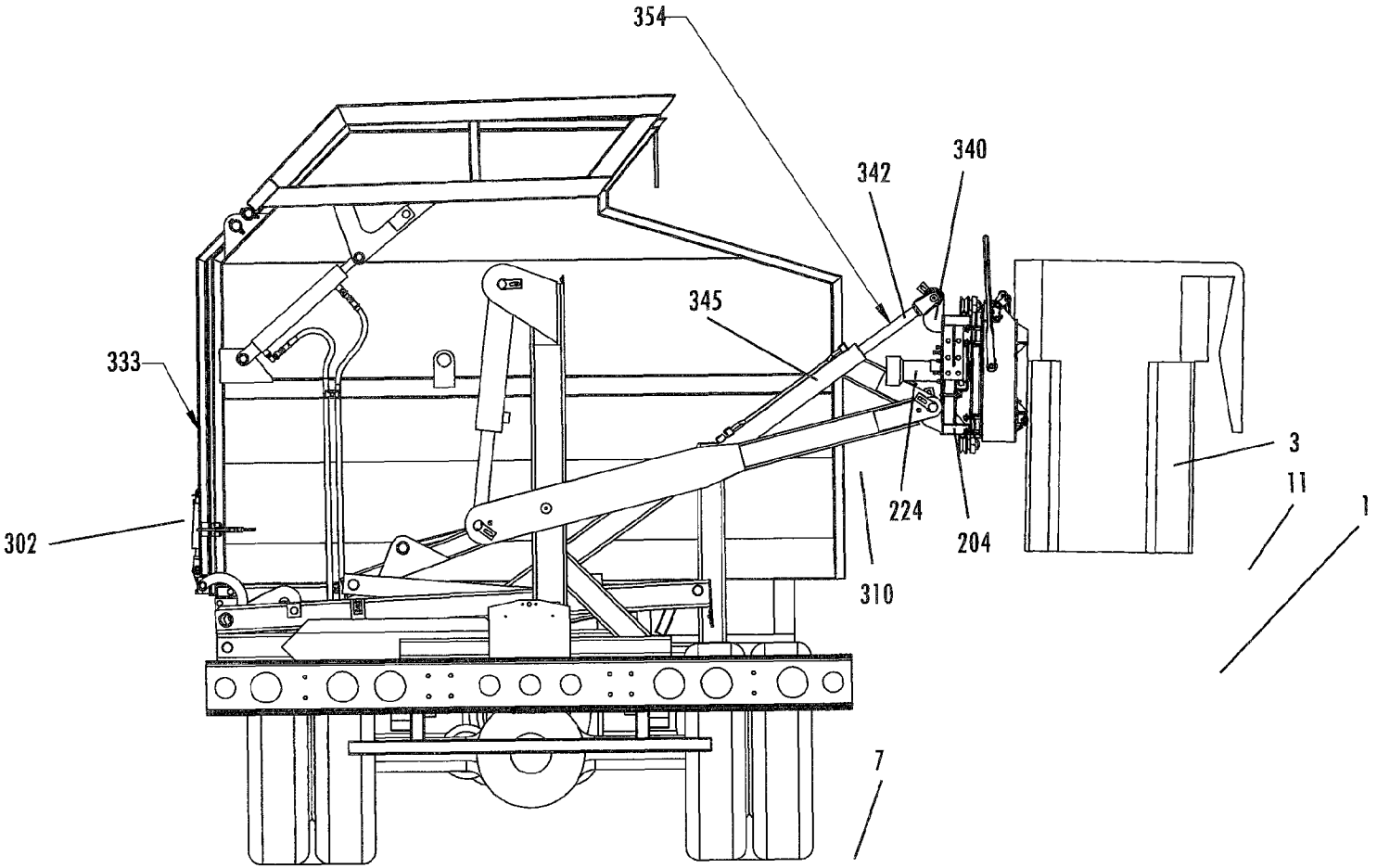
FIG. 27 is a rear view of the refuse collection truck of FIG. 27 shown with the collection mechanism partially raised after attachment of a refuse bin stationed on an elevated loading dock.

FIG. 27 depicts the bail assembly 310 raising a refuse bin 3 from an elevated platform or dock 1 which has to top surface 11 forty-eight inches above ground level 7. It is seen that cylinder 345 has extended rod 342 as bail 310 has been raised, thereby maintaining refuse bin 3 in a fully upright position. After refuse bin 3 has been lifted off the dock 1, the refuse bin 3 can be laterally moved into proper position on track 204 to locate it alongside the selected hopper on collection vehicle 302. Positioning of carriage 206 along track 204 is accomplished by operation of reversible motor 224 and a chain 226 or cable (See. FIG. 13). Motor 224 is preferably a hydraulic motor but an electric motor could alternatively be used.

Figure 28:
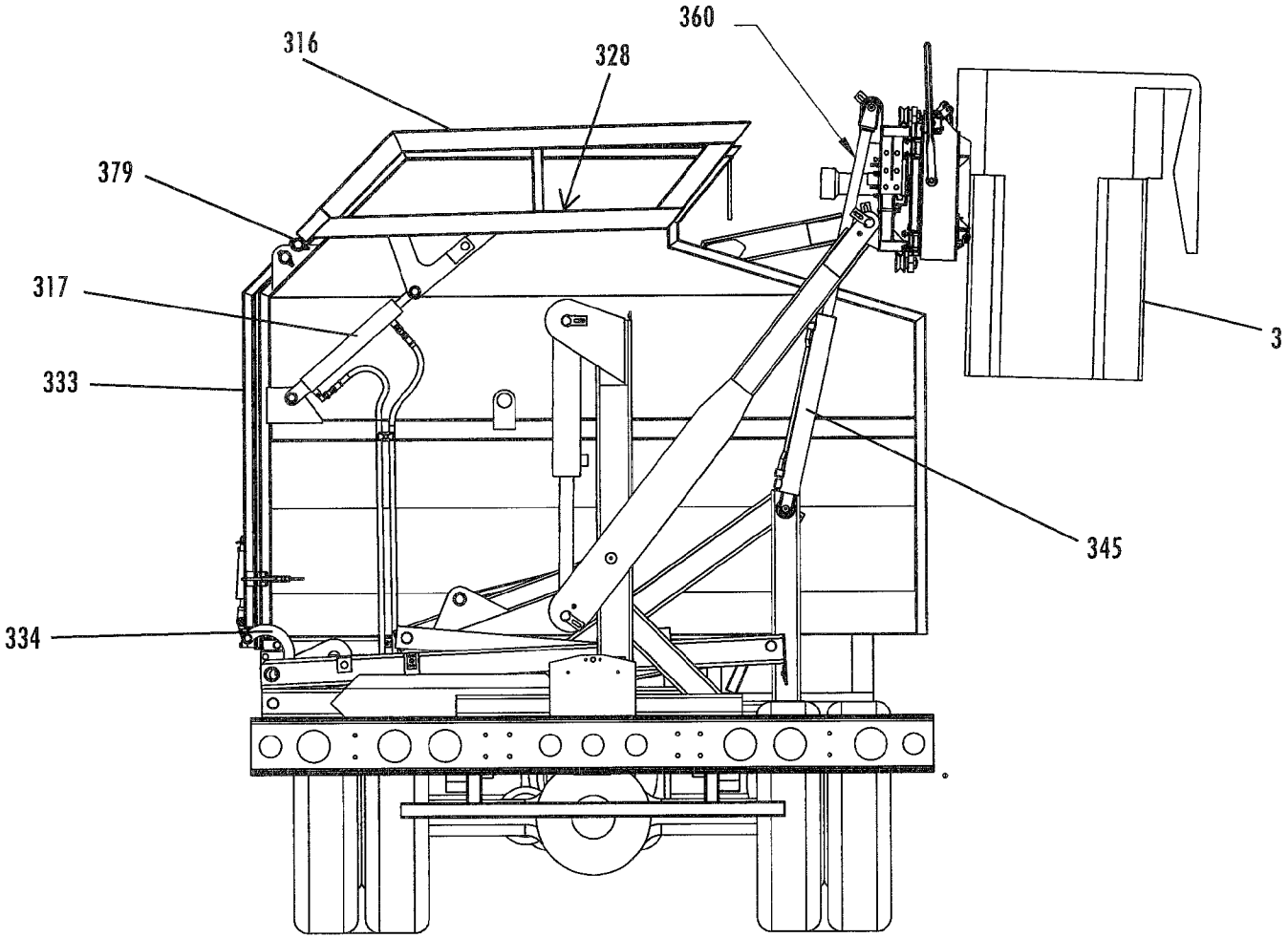
FIG. 28 is a rear view of the refuse collection truck of FIG. 27 shown with the collection mechanism raised while maintaining the refuse bin retained thereto in an upright orientation.

As bail assembly 310 raises refuse bin 3 as seen in FIG. 28, cylinder 345 is caused to extend rod 360 further to maintain the upright orientation of refuse bin 3, thereby avoiding premature spillage from refuse bin 3 before it is positioned over load opening and before cover 316 has been raised by positioning it about hinge 379. Discharge wall 333 remains latched in place by catch 334. Cover 316 is raised by operation of lift cylinder 317.

Figure 29:
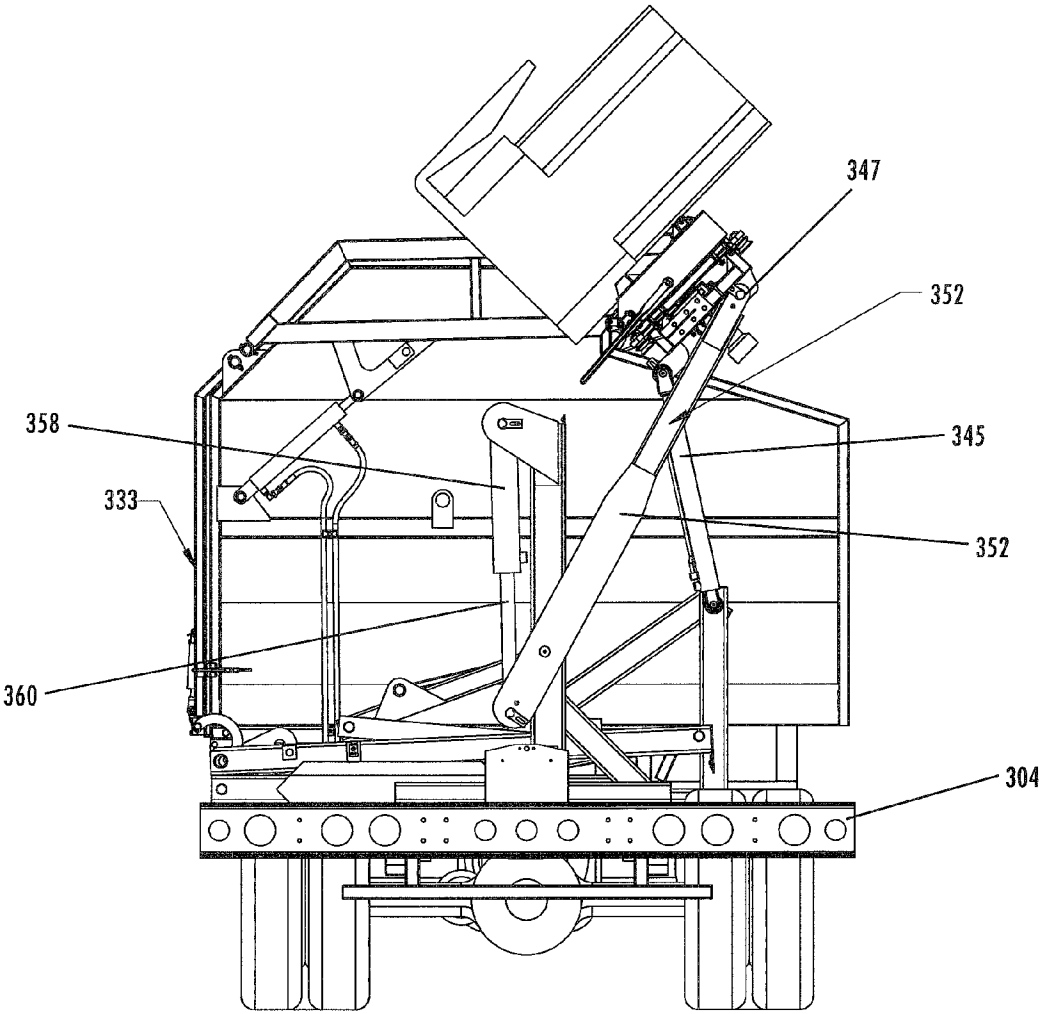
FIG. 29 is a rear view of the refuse collection truck of FIG. 27 shown with the collection mechanism fully raised and tipping the refuse bin over a top opening of a hopper on the refuse collection truck.

FIG. 29 depicts the refuse bin 3 being inverted such that its commodity contents would drop into the load opening of the omitted rear mount hopper, after its cover had been raised.

Pivot arms 352 have rotated to the uppermost position through extension of rod 360 from drive cylinder 358. In order to rotate refuse bin 3 to its inverted dumping position as seen in FIG. 29, cylinder 345 has retracted its rod 342 and caused track 204 to rotate about axle 347. After its contents have been allowed to drop into the hopper on chassis 304, pivot arms 352 rotate in a clockwise direction while cylinder 345 extends, righting refuse bin 3 as it is returned to its starting point.

It is also to be understood that track 204 includes a movable carriage 206 (See FIGS. 6-8) which permits the refuse bin 3 to be returned to a position along or to the rear of the collection vehicle 304.

Various other aspects of any of the embodiments can be combined in different combinations than the ones shown to create new embodiments that fall within the scope of the appended claims.

While the present invention has been particularly shown and described with reference to preferred embodiments thereof, it should be understood by those of ordinary skill in the art that various changes, substitutions and alterations can be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising".

What is claimed is:

1. A collection mechanism for a side loaded commodity collection body having at least one collection chamber attached thereto, the collection body having a first end and a second end, the collection mechanism comprising:

a track extending longitudinally along a side of the collection body and being moveable between a raised position above the at least one collection chamber and a lowered position;

a carriage engaged with the track for linear movement on the track between a position alongside the at least one collection chamber and a position extending longitudinally from the second end of the collection body; and at least one container engagement assembly attached to the carriage and positioned in an outward facing position with respect to the side of the collection body to receive a container and selectively engage the container for movement of the container along the track, the container movable with the track between the raised and lowered positions thereof.

2. The collection mechanism of claim 1 wherein the track is supported on a plurality of support arms, the support arms supported on a chassis of a commodity collection vehicle supporting the commodity collection body, a linkage arm joined to the track, the linkage arm rotating the track around a hinge on the support arms when the track is moved to the raised position.

3. The collection mechanism of claim 1 wherein the carriage is moveable along the length of the track upon rollers receivable on upper and lower members of the track.

4. The collection mechanism of claim 1 wherein the container engagement assembly includes a plurality of upstanding vertical tines to be received by pockets on the container, the container engagement assembly further including a mechanism to clamp the pockets on the tines.

5. In a commodity collection vehicle having a chassis supported on wheels and further having at least one commodity storage hopper supported thereon, the chassis having a first end and a second end, the invention comprising:

a refuse container unloading assembly comprising a track supported on pivot arms supported on the chassis, the track extending along the chassis at least a length of the at least one storage hopper, the track including a carriage selectively moveable therealong, the carriage including a refuse bin mounting member thereon, the carriage moveable selectively along the track to any location therealong, the carriage moveable to a position extending longitudinally from the second end of the chassis, the carriage selectively moveable to a position alongside the at least one storage hopper, the track moveable by action of the pivot arms from a lowered position to a fully raised position, whereby a refuse container secured by the refuse bin mounting member will be upended over a load opening of the at least one storage hopper when the track is moved to the fully raised position.

6. The commodity collection vehicle of claim 5 wherein the commodity collection vehicle comprises at least a forward commodity storage hopper and a rearward commodity storage hopper supported on the chassis thereof, the track extending along at least a length of the storage hoppers, the carriage selectively moveable to a position alongside a selected one of the at least a forward commodity storage hopper and a rearward commodity storage hopper, the refuse container being upended over the load opening of the selected one of the at least a forward commodity storage hopper and a rearward commodity storage hopper.

7. The commodity collection vehicle of claim 5 wherein the carriage moveable on rollers engaged with the track, the carriage selectively moved along the track by a cable drawn along the track by a hydraulic motor.

8. The commodity collection vehicle of claim 5 wherein the carriage is moveable along the track by operation of a wireless remote control used by an operator.

9. The commodity collection vehicle of claim 5 wherein the track including a length extending from the second end of the commodity collection vehicle, means to move the carriage along the track, means to raise the track from the lower position to any height up to the raised position, control means to remotely move the carriage along the track and to raise and lower the track over the at least one storage hopper.

10. The commodity collection vehicle of claim 5 wherein the track includes a length thereof extending from the second end of the commodity collection vehicle.

11. The commodity collection vehicle of claim 5 wherein the track is supported on a plurality of support arms, the support arms supported on a chassis of a commodity collection vehicle supporting the commodity collection body, a linkage arm joined to the track, the linkage arm including a hydraulic cylinder, the hydraulic cylinder of the linkage arm selectively rotating the track around a hinge on the support arms when the track is moved to the raised position to upend the container over a load opening of the at least one collection chamber.

12. The commodity collection vehicle of claim 5 wherein the track including a length thereof extending from the second end of the commodity collection vehicle, the commodity collection vehicle comprising at least a forward commodity storage hopper and a rearward commodity storage hopper supported on the chassis thereof, the track extending along at least a length of the storage hoppers, the carriage moveable on rollers engaged with the track, the carriage selectively moved along the track by a cable drawn along the track by a hydraulic motor, the carriage selectively moveable to a position alongside a selected one of the at least a forward commodity storage hopper and a rearward commodity storage hopper, the track supported on a plurality of support arms, the support arms supported on the chassis of the commodity collection vehicle, a linkage arm joined to the track, the linkage arm rotating the track around a hinge on the support arms when the track is moved to the raised position, the refuse container being upended over the load opening of the selected one of the at least a forward commodity storage hopper and a rearward commodity storage hopper, the carriage moveable along the track by operation of a wireless remote control used by an operator.

13. In a commodity collection vehicle having a chassis supported on wheels and further having at least one commodity storage hopper supported thereon, the chassis having a first end and a second end, the invention comprising:

a refuse container unloading assembly comprising a track supported on pivot arms supported on the chassis, the track extending along the chassis at least a length of the at least one storage hopper, the track including a carriage selectively moveable therealong, the carriage including a refuse bin mounting member thereon, the carriage moveable selectively along the track to any location therealong, the carriage moveable to a position extending from the second end of the chassis, the carriage selectively moveable to a position alongside the at least one storage hopper, the track moveable by action of the pivot arms from a lowered position to a fully raised position, whereby a refuse container secured by the refuse bin mounting member will be upended over a load opening of the at least one storage hopper when the track is moved to the fully raised position;

the carriage includes a support leg depending therefrom, a wheel carried on a lower end of the support leg, the wheel rolling along a surface on which a refuse container is resting to support the carriage thereon.

* * * * *